US008752932B2

(12) United States Patent
Jung et al.

(10) Patent No.: US 8,752,932 B2
(45) Date of Patent: Jun. 17, 2014

(54) WIPING ASSEMBLY AND IMAGE FORMING APPARATUS HAVING THE SAME

(75) Inventors: Youn-gun Jung, Yongin-si (KR); Karp-sik Youn, Hwaseong-si (KR); Young-su Lee, Suwon-si (KR); Gun Heo, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 592 days.

(21) Appl. No.: 12/706,873

(22) Filed: Feb. 17, 2010

(65) Prior Publication Data

US 2011/0043567 A1 Feb. 24, 2011

(30) Foreign Application Priority Data

Aug. 24, 2009 (KR) ..... 10-2009-0078198

(51) Int. Cl.
*B41J 2/165* (2006.01)

(52) U.S. Cl.
USPC ..... 347/32

(58) Field of Classification Search
None
See application file for complete search history.

(56) References Cited

U.S. PATENT DOCUMENTS 4,829,318 A * 5/1989 Racicot et al. ..... 347/33
6,637,856 B2 10/2003 Nishi et al.
6,637,858 B2 10/2003 Wotton et al.
2004/0218002 A1 11/2004 Nakamura
2006/0238563 A1* 10/2006 Nakamura ..... 347/33
2008/0226308 A1 9/2008 Burmeister et al.
2009/0289993 A1* 11/2009 Yamaguchi ..... 347/33

FOREIGN PATENT DOCUMENTS

JP 59079272 5/1984
JP 2008229962 10/2008
KR 20040055668 6/2004
KR 20060098332 9/2006

* cited by examiner

*Primary Examiner* — Alejandro Valencia
(74) *Attorney, Agent, or Firm* — Stanzione & Kim, LLP

(57) ABSTRACT

An inkjet image forming apparatus includes a main body frame, a medium supplying unit which is coupled to the main body frame and supplying a print medium, an image forming cartridge which is coupled to the main body frame, forms an image on the supplied print medium, and including a nozzle to eject ink, and a wiping assembly which wipes the nozzle. The wiping assembly includes a wiping sheet storage unit in which the wiping sheet is stored as being wound, a transfer shuttle which moves along arrangement of the nozzle by a driving force of a driving source, a pressing member which is provided in the transfer shuttle and presses a region of the wiping sheet against the nozzle to perform wiping using the wiping sheet, and a wiping sheet support unit which is provided in the transfer shuttle and restricts move of the wiping sheet while the nozzle is wiped.

14 Claims, 19 Drawing Sheets

WIPING ASSEMBLY AND IMAGE FORMING APPARATUS HAVING THE SAME

CROSS-REFERENCE TO RELATED APPLICATIONS

This application claims priority under 35 U.S.C. §119 from Korean Patent Application No. 10-2009-0078198, filed on Aug. 24, 2009 in the Korean Intellectual Property Office, the disclosure of which is incorporated herein by reference.

BACKGROUND

1. Field of the Invention

The present general inventive concept relates to an inkjet image forming apparatus to form an image on a print medium, and more particularly, to a wiping assembly to wipe an image forming cartridge that ejects ink to form an image, and an inkjet image forming apparatus having the same.

2. Description of the Related Art

An image forming apparatus may employ various methods for forming an image on a print medium. Among various methods, there is an inkjet method for ejecting ink on the print medium. Such an inkjet-type image forming apparatus is also classified into a shuttle type where an image forming cartridge ejects ink while moving in a width direction of the print medium, and an array type where the image forming cartridge fixed as extended along the width direction of the print medium.

In the inkjet image forming apparatus, a nozzle is likely to be stained with a foreign material such as remaining ink or impurities as used in forming an image on the print medium. Such a foreign material interrupts ejection of ink by blocking the nozzle or is thrown on the print medium together with the ejected ink, thereby deteriorating quality of an image. Accordingly, a wiping assembly is necessary for removing the foreign material.

To clean the nozzle, a conventional wiping assembly applied to the array-type image forming cartridge employs a method of the ejecting a predetermined amount of ink inside the cartridge at high pressure, or a method of pressing the nozzle against an absorptive roller, a blade or the like.

However, the method of ejecting the ink wastes the ink needed for forming an image and may stain the inside of the image forming apparatus with the ejected ink. Further, the absorptive roller or the blade needs frequent replacement since the lifespan thereof is short, thereby deteriorating convenience. In the case of the array-type image forming cartridge, since the nozzles are long arranged along the width direction of the print medium, the wiping assembly also become larger and complicated, so that the image forming apparatus cannot be minimized.

SUMMARY

The preset general inventive concept provides a wiping assembly, which can have a simple and small-scaled structure and prolong a replacement cycle of a wiping element in performing a wiping process applied to an image forming cartridge, and an inkjet image forming apparatus having the same.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept can be achieved by providing an inkjet image forming apparatus including a main body frame, a medium supplying unit which is coupled to the main body frame and supplying a print medium, an image forming cartridge which is coupled to the main body frame, forms an image on the supplied print medium, and including a nozzle to eject ink, and a wiping assembly which wipes the nozzle, the wiping assembly including, a wiping sheet storage unit in which the wiping sheet is stored as being wound, a transfer shuttle which moves along arrangement of the nozzle by a driving force of a driving source, a pressing member which is provided in the transfer shuttle and presses a region of the wiping sheet against the nozzle to perform wiping using the wiping sheet, and a wiping sheet support unit which is provided in the transfer shuttle and restricts move of the wiping sheet while the nozzle is wiped.

The wiping sheet support unit may apply tension to the wiping sheet in a direction opposite to friction acting between the nozzle and the wiping sheet when performing the wiping.

The wiping sheet support unit may include a plurality of support gears matching with each other with the wiping sheet therebetween to support the wiping sheet.

The transfer shuttle may include a first shuttle frame which moves between a standby position corresponding to one side end of the nozzle and a return position corresponding to the other side end of the nozzle; and a second shuttle frame in which the pressing member is provided, and which is coupled to the first shuttle frame so that the pressing member is movable between a press position to press the wiping sheet against the nozzle and a separate position separated from the press position.

The wiping assembly may further include a frame position shifting unit makes the second shuttle frame stay at the press position when the first shuttle frame moves from the standby position to the return position, but makes the second shuttle frame at the separate position when the first shuttle frame moves from the return position to the standby position.

The wiping assembly may further include a wiping sheet moving unit which makes the region of the wiping sheet pressed by the pressing member move as much as a predetermined section.

The wiping sheet storage unit may store one side of the wiping sheet not used in the wiping to be supplied to the transfer shuttle, but collects and stores the other side of the wiping sheet used in the wiping from the transfer shuttle.

The wiping sheet storage unit includes a storage unit housing in which the wiping sheet is stored; a supplying-side reel which is provided in the storage unit housing and around which one side of the wiping sheet not used in the wiping is wound; and a collecting-side reel which is provided in the storage unit housing and around which the other side of the wiping sheet used in the wiping is wound.

The transfer shuttle may move between the standby position corresponding to the one side end of the nozzle and the return position corresponding to the other side end of the nozzle, and the supplying-side reel and the collecting-side reel may be provided to release the wound wiping sheet when the transfer shuttle moves from the standby position to the return position, but receive the driving force from the driving source to wind the released wiping sheet when the transfer shuttle moves from the return position to the standby position.

The supplying-side reel and the collecting-side reel may spin idly without winding the wiping sheet if receiving a load more than a preset value while winding the wiping sheet as the transfer shuttle moves to the standby position.

The transfer shuttle may move between the standby position corresponding to the one side end of the nozzle and the return position corresponding to the other side end of the nozzle, and the wiping assembly may include a power transmission control unit that cuts off the driving force for winding the wiping sheet from being transmitted to the supplying-side reel and the collecting-side reel when the transfer shuttle moves from the standby position to the return position, but allows the driving force to be transmitted to the supplying-side reel and the collecting-side reel when the transfer shuttle moves from the return position to the standby position.

The wiping sheet storage unit may be placed in one of opposite ends of a moving course for the transfer shuttle.

The wiping sheet storage unit may be provided substantially perpendicularly to the moving direction of the transfer shuttle.

The foregoing and/or other aspects and utilities of the present general inventive concept can also be achieved by providing a wiping assembly usable with an inkjet image forming apparatus, including, a wiping sheet storage unit in which a wiping sheet is stored as being wound, a transfer shuttle which moves along arrangement of a nozzle by a driving force of a driving source, a pressing member which is provided in the transfer shuttle and presses a region of the wiping sheet against the nozzle to perform wiping using the wiping sheet, and a wiping sheet support unit which is provided in the transfer shuttle and restricts move of the wiping sheet while the nozzle is wiped.

The foregoing and/or other aspects and utilities of the present general inventive concept can also be achieved by providing a wiping assembly usable with an inkjet image forming apparatus having an image forming cartridge with one or more nozzles, including a wiping sheet storage unit having a housing to store a wiping sheet to wipe the nozzles, one or more reels disposed in the hosing and connected to the wiping sheet to selectively hold and release the wiping sheet, and an opening formed on the housing to allow the wiping sheet to be released at least one of the reels by a length corresponding to a length of the image forming cartridge.

The foregoing and/or other aspects and utilities of the present general inventive concept can also be achieved by providing a wiping assembly usable with an inkjet image forming apparatus having an image forming cartridge with one or more nozzles, including a transfer shuttle to receive a wiping sheet to wipe nozzles in wiping operation, and having a first shuttle frame to move along the image forming cartridge and a second shuttle frame movably disposed in the first shuttle to move the received wiping sheet with respect to the first shuttle frame and the image forming cartridge to perform the wiping operation.

The wiping assembly may further include a pressing member disposed in the second shuttle frame to bias the wiping sheet toward the nozzle to perform the wiping operation.

The wiping assembly may further include a wiping support unit disposed in the second shuttle frame to provide a tension to control a movement of the wiping sheet with respect to the second shuttle frame during the wiping operation.

The foregoing and/or other aspects and utilities of the present general inventive concept can also be achieved by providing a wiping assembly usable with an inkjet image forming apparatus having an image forming cartridge with one or more nozzles, including a wiping sheet storage unit having a housing to store a wiping sheet to wipe the nozzles, one or more reels disposed in the hosing and connected to the wiping sheet to selectively hold and release the wiping sheet, and an opening formed on the housing to allow the wiping sheet to be released at least one of the reels by a length corresponding to a length of the image forming cartridge, and a transfer shuttle to receive a wiping sheet from the wiping sheet storage unit to wipe nozzles in wiping operation, and having a first shuttle frame to move along the image forming cartridge and a second shuttle frame movably disposed in the first shuttle to move the received wiping sheet with respect to the first shuttle frame and the image forming cartridge to perform the wiping operation.

The foregoing and/or other aspects and utilities of the present general inventive concept can also be achieved by providing a wiping assembly usable with an inkjet image forming apparatus having an image forming cartridge with one or more nozzles, including a wiping sheet storage unit to store a wiping sheet to wipe the nozzles, to selectively hold and release the wiping sheet, and to allow the wiping sheet to be released at least one of the reels by a length corresponding to a length of the image forming cartridge, and a transfer shuttle to receive a wiping sheet from the wiping sheet storage unit, to move along the image forming cartridge, and to move the received wiping sheet with respect to the image forming cartridge to perform the wiping operation.

The foregoing and/or other aspects and utilities of the present general inventive concept can also be achieved by providing a image forming apparatus including a main frame, an image forming cartridge formed on the main frame and with one or more nozzles, a wiping sheet storage unit disposed on the main frame to store a wiping sheet to wipe the nozzles, to selectively hold and release the wiping sheet, and to allow the wiping sheet to be released at least one of the reels by a length corresponding to a length of the image forming cartridge, and a transfer shuttle movably disposed on the main frame to receive a wiping sheet from the wiping sheet storage unit, to move along the image forming cartridge, and to move the received wiping sheet with respect to the image forming cartridge to perform the wiping operation.

The foregoing and/or other aspects and utilities of the present general inventive concept can also be achieved by providing a method of a wiping assembly usable with an inkjet image forming apparatus having an image forming cartridge with one or more nozzles, the method including disposing a wiping sheet storage unit to store a wiping sheet to wipe the nozzles in a wiping operation, to selectively hold and release the wiping sheet, and to allow the wiping sheet to be released at least one of the reels by a length corresponding to a length of the image forming cartridge, and moving the wiping sheet along the image forming cartridge with respect to the image forming cartridge to perform the wiping operation.

The foregoing and/or other aspects and utilities of the present general inventive concept can also be achieved by providing a computer-readable medium to contain computer-readable codes as a program to perform a method of a wiping assembly usable with an inkjet image forming apparatus having an image forming cartridge with one or more nozzles, the method including disposing a wiping sheet storage unit to store a wiping sheet to wipe the nozzles in a wiping operation, to selectively hold and release the wiping sheet, and to allow the wiping sheet to be released at least one of the reels by a length corresponding to a length of the image forming cartridge, and moving the wiping sheet along the image forming cartridge with respect to the image.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE EMBODIMENTS

Figure 1:
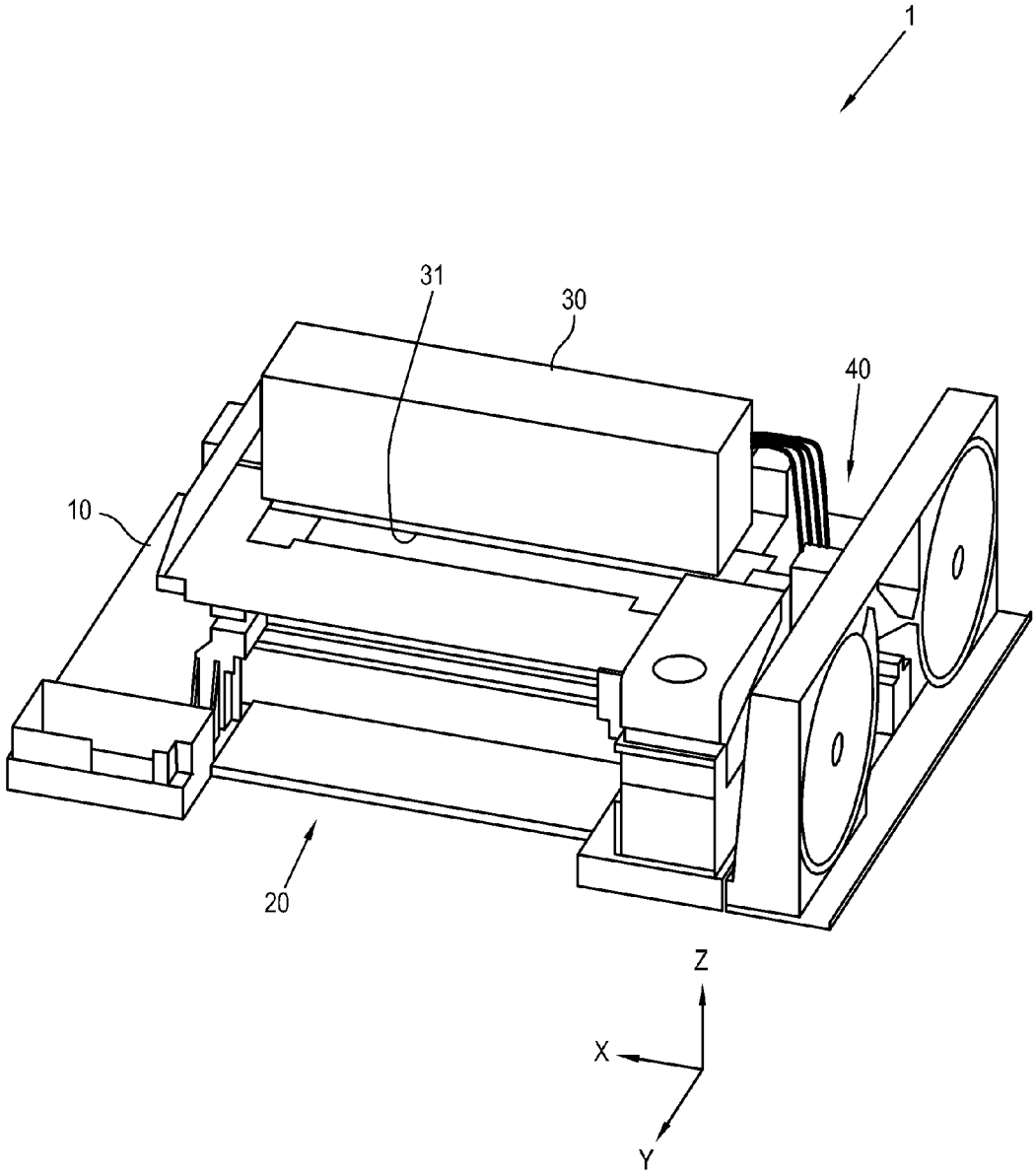
FIG. 1 is an exploded perspective view illustrating an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

According to an exemplary embodiment of the present general inventive concept, an image forming apparatus may be an inkjet-type image forming apparatus and includes configurations to perform a wiping process on an array-type image forming cartridge. However, the present general inventive concept is not limited thereto. Other types of image forming apparatuses may be used as the image forming apparatus. Since general structures and/or operations of the image forming apparatus are well known, detail descriptions thereof will be omitted from the following descriptions.

FIG. 1 is an exploded perspective view of an image forming apparatus 1 according to an exemplary embodiment of the present general inventive concept.

In the drawings, directions of X, Y and Z are orthogonal to one another or substantially perpendicular to one another. Regarding the image forming apparatus 1, the X direction indicates a length direction, the Y direction indicates a breadth direction, and the Z direction indicates a height direction. The image forming apparatus 1 is installed on an X-Y plane that includes axes of both X and Y directions. Also, -X, -Y and -Z are opposite to X, Y and Z, respectively.

As illustrated in FIG. 1, the image forming apparatus 1 according to an exemplary embodiment of the present general inventive concept includes a main body frame 10, a medium supplying unit 20 coupled to the main body frame 10 to pickup, feed, and/or supply a print medium, an image forming cartridge 30 to eject ink on to the print medium supplied from the medium supplying unit 20 and to form an image according to an input image signal, and a wiping assembly 40 perform a wiping process with respect to the image forming cartridge 30.

The image forming cartridge 30 is mounted to the main body frame 10, and includes nozzles 31 sequentially arranged to eject the ink along the X direction, i.e., a width direction of the print medium and directed toward the -Z direction. During a printing job, an image line is formed by the ink ejected from the nozzle 31 along the X direction of the print medium and a completed image is formed by the ink on the print medium as the print medium moves in the Y direction.

As the printing jobs are repeated, the nozzle 31 is stained with a foreign material such as remaining ink or impurities. Such a foreign material interrupts ejection of ink by blocking the nozzle or is thrown on the print medium together with the ejected ink, thereby deteriorating quality of an image. Accordingly, to solve these problems, the wiping assembly 40 performs the wiping process to remove a foreign material from the nozzle 31 periodically or randomly by a preset period or in response to a user's command as illustrated in FIG. 16.

Figure 16:
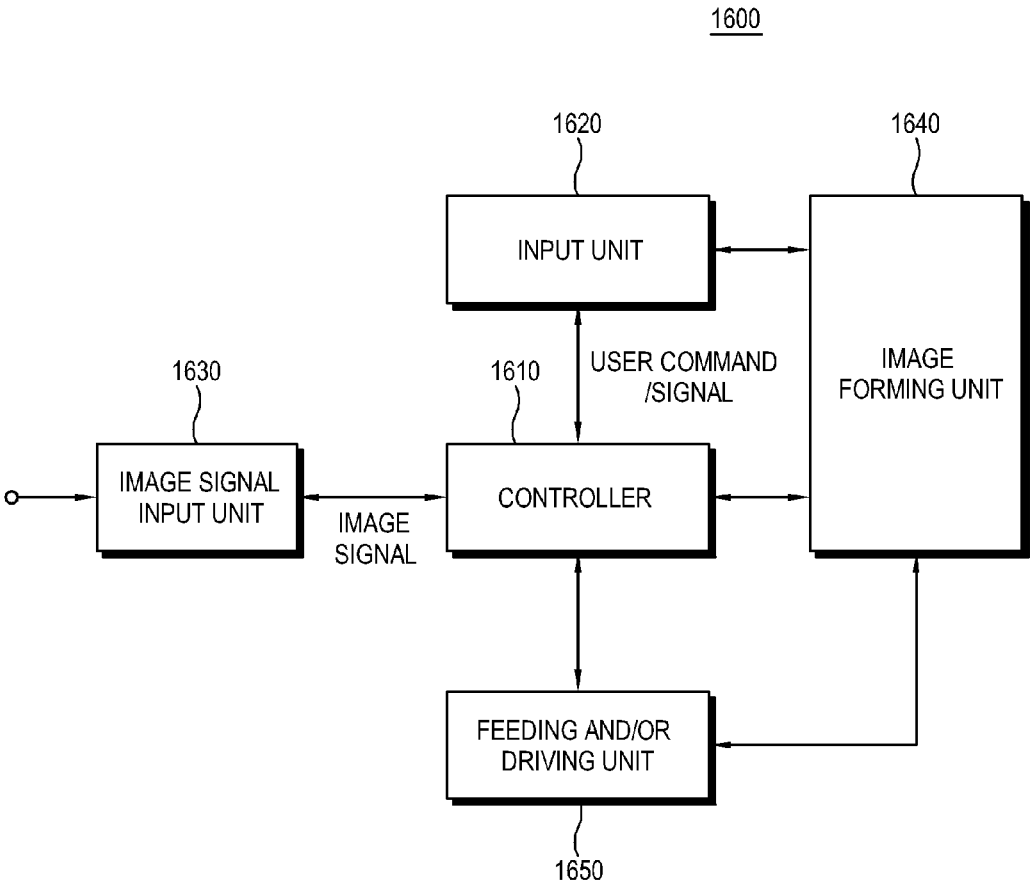
FIG. 16 is a block diagram illustrating an image forming apparatus according to an embodiment of the present general inventive concept.

Referring to FIG. 16, an image forming apparatus 1600 may include a controller 1610, an input unit 1620, an image signal input unit 1630, an image forming unit 1640, and a feeding and/or driving unit 1650. The input unit 1620 generates a user command or a user signal, and the generated user command or signal is transmitted to the controller 1610. The image signal input unit 1630 receives a signal representing an image to be printed. The image signal input unit 1630 may be an interface to receive the signal from an external apparatus or a device to scan an object to generate the signal corresponding to the scanned object, to be printed in the image forming unit 1640. The feeding and/or driving unit 1650 generates one or more driving signals to drive one or more motors to pick up a printing medium in a pick unit (not illustrated), to feed the printing medium in a feeding unit (not illustrated), to control mechanism of the image forming unit 1640 to form an image corresponding to the signal, and to control mechanism of the wiping assembly 40 to perform a maintenance operation, for example, the wiping. It is possible that the wiping assembly 40 may be included in at least a portion of the image forming unit 1640 or the feeding and driving unit 1650. The controller 1610 controls the feeding and/or driving unit 1650 and the image forming unit 1640 to form an image or perform the wiping process, according to the received signals or commands.

Below, the wiping assembly 40 will be described with reference to FIG. 2.

Figure 2:
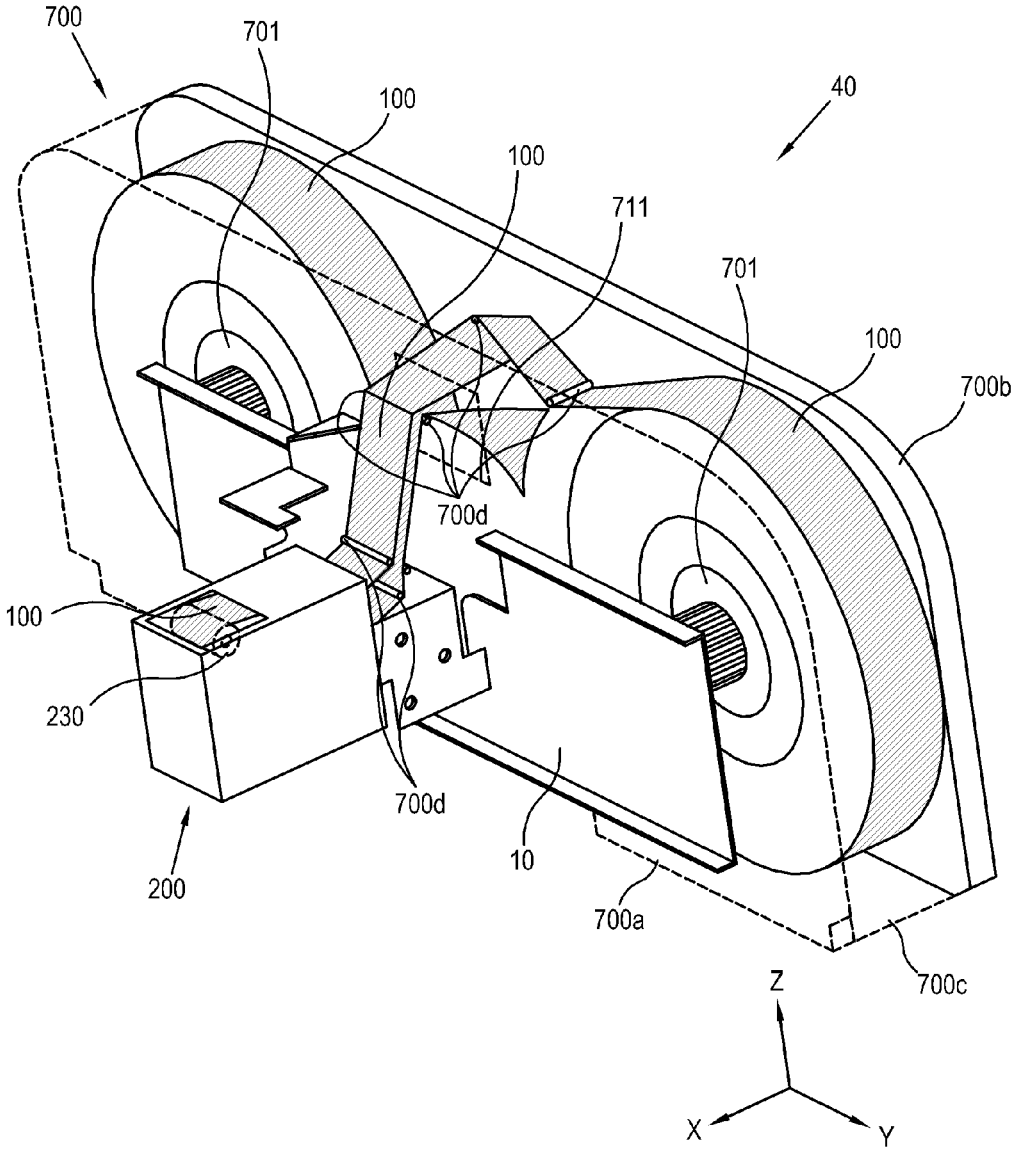
FIG. 2 is a partial perspective view illustrating a wiping assembly in the image forming apparatus of FIG. 1.

FIG. 2 is a partial perspective view of a wiping assembly in the image forming apparatus of FIG. 1.

As illustrated in FIG. 2, the wiping assembly 40 includes a wiping sheet 100 shaped like a belt having a narrow width and extended to be wound around reels 701, and a transfer shuttle 200 to support a region of the wiping sheet 100. The transfer shuttle 200 may be movable with respect to the nozzles 31 or a wiping sheet storage unit 700.

Figure 18A:
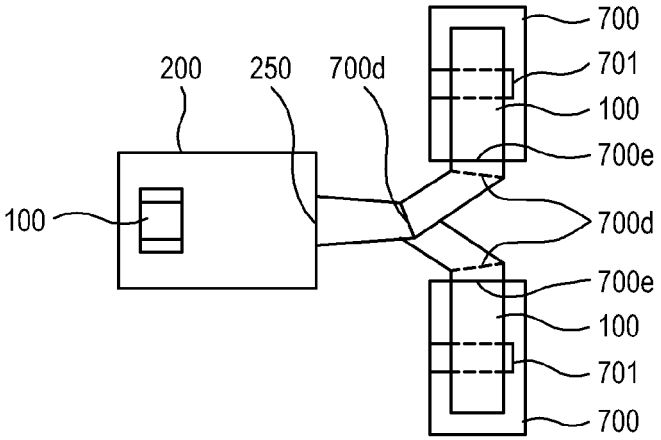
Figure 18B:
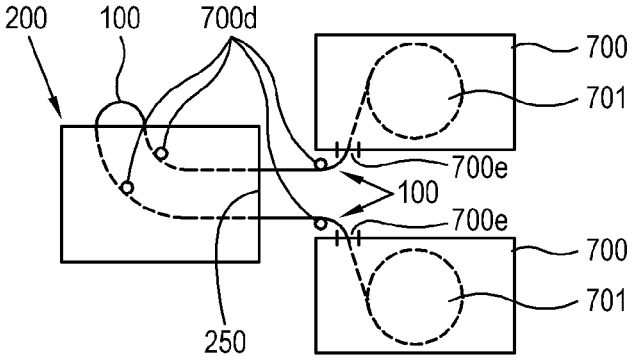

The wiping sheet storage unit 700 of the wiping assembly 40 stores the wiping sheet 100. One side of the wiping sheet 100 which is not used in wiping is stored in the wiping sheet storage unit 700 to be supplied to the transfer shuttle 200, and the other side of the wiping sheet 100 which have been used in the wiping is collected from the transfer shuttle 200 and stored in the wiping sheet storage unit 700. In this embodiment, the wiping sheet storage unit 700 stores both one side of the wiping sheet 100 not in used in the wiping and the other side of the wiping sheet 100 used in the wiping. The wiping sheet storage unit 700 may include a first portion corresponding to one of the reels 701 to store the wiping sheet 100 which is not used for the wiping, and a second portion corresponding to the other one of the reels 701 to store the wiping sheet 100 which has been used for the wiping. However, the present general inventive concept is not limited thereto. It is possible that the first and second portions of the wiping sheet 100 may be stored in separate first and second configurations (structures) which are spaced apart from each other by a distance as illustrated in FIGS. 18A and 18B.

The wiping sheet storage unit 700 may include two portions 700*a* and 700*b* disposed opposite to each other with respect to the wiping sheet 100 or the reels 701, and a side wall 700*c* disposed between the two portions 700*a* and 700*b* to provide a space to accommodate the wiping sheet 100 and the reels 701. The portions 700*a* and 700*b* and the side wall 700*c* may form a frame of the wiping sheet storage unit 700. An opening 711 is formed on one of the two portions 700*a* and 700*b* as a passage through which at least a portion of the wiping sheet 100 is connected to the transfer shuttle 200.

The wiping sheet 100 is wound around the reels 701, and at least a portion of wiping sheet 100 is guided by one or more support rollers 700*d* rotatably disposed in the frame of the wiping sheet storage unit 700. The wiping sheet 100 can be extracted from the frame of the wiping sheet storage unit 700 to be inserted into the transfer shutter 200. For example, the wiping sheet 100 is wound around the reels 701 in a first direction, and a portion of the wiping sheet 100 is guided by the support guides to protrude toward the transfer shuttle 200 through the opening in a second direction having an angle with the first direction. The second direction may be perpendicular to the first direction. The portion of the wiping sheet 100 may be inserted into the transfer shuttle 200 from the opening 711 of the frame in a third direction which may be different from the first and second directions.

Although FIG. 2 illustrates the opening 711 to be formed on the one of the first and second portions 700*a* and 700*b*, it is possible that the opening 711 may be formed on the side wall 700*c*. In this case, additional support guides are disposed to guide the portion of the wiping sheet 100 to be extracted from the opening 711 and inserted into the transfer shuttle 200. However, the present general inventive concept is not limited thereto. It is possible that the first, second, and third directions may be same, and the location of the opening may be different from the above described locations.

Figure 17A:
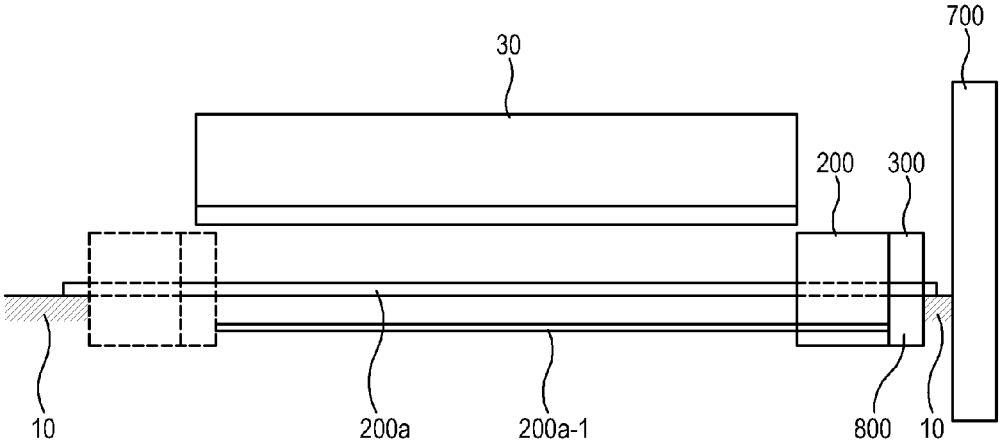
FIGS. 17A to 18C are views illustrating a wiping assembly of an image forming apparatus according to an embodiment of the present general inventive concept.
Figure 17B:
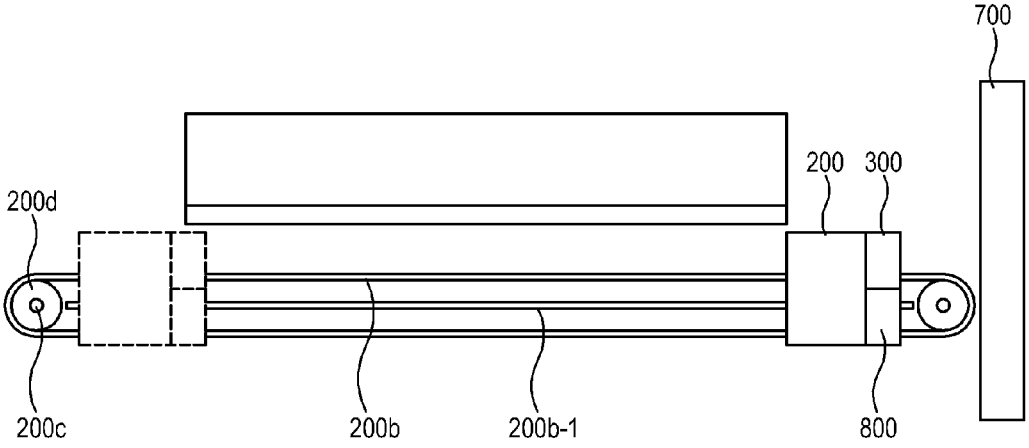

The transfer shuttle 200 receives and supports a region of the wiping sheet 100 supplied from the wiping sheet storage unit 700, and moves and returns in the X direction. The transfer shuttle 200 may be achieved together with a rail, a belt and a driving unit which are illustrated in FIGS. 17A and 17B which will be described later.

The transfer shuttle 200 includes a pressing member 230 to support a region (or portion) of the wiping sheet 100 in the Z direction. The pressing member 230 is installed at an opened top of the transfer shuttle 200, and the wiping sheet 100 is wound around the periphery of the pressing member 230, so that the wiping can be performed in a region of the wiping sheet 100 supported by the pressing member 230.

The pressing member 230 may be shaped like a roller, and a radial direction of the roller may be parallel to the X-Z plane, so that the wiping sheet 100 can be wound around a curved surface of the pressing member 230. The pressing member 230 may be fixed not to rotate, or may be rotatably coupled to the transfer shuttle 200.

Below, a wiping method according to move of the transfer shuttle 200 will be described with reference to FIG. 3.

Figure 3:
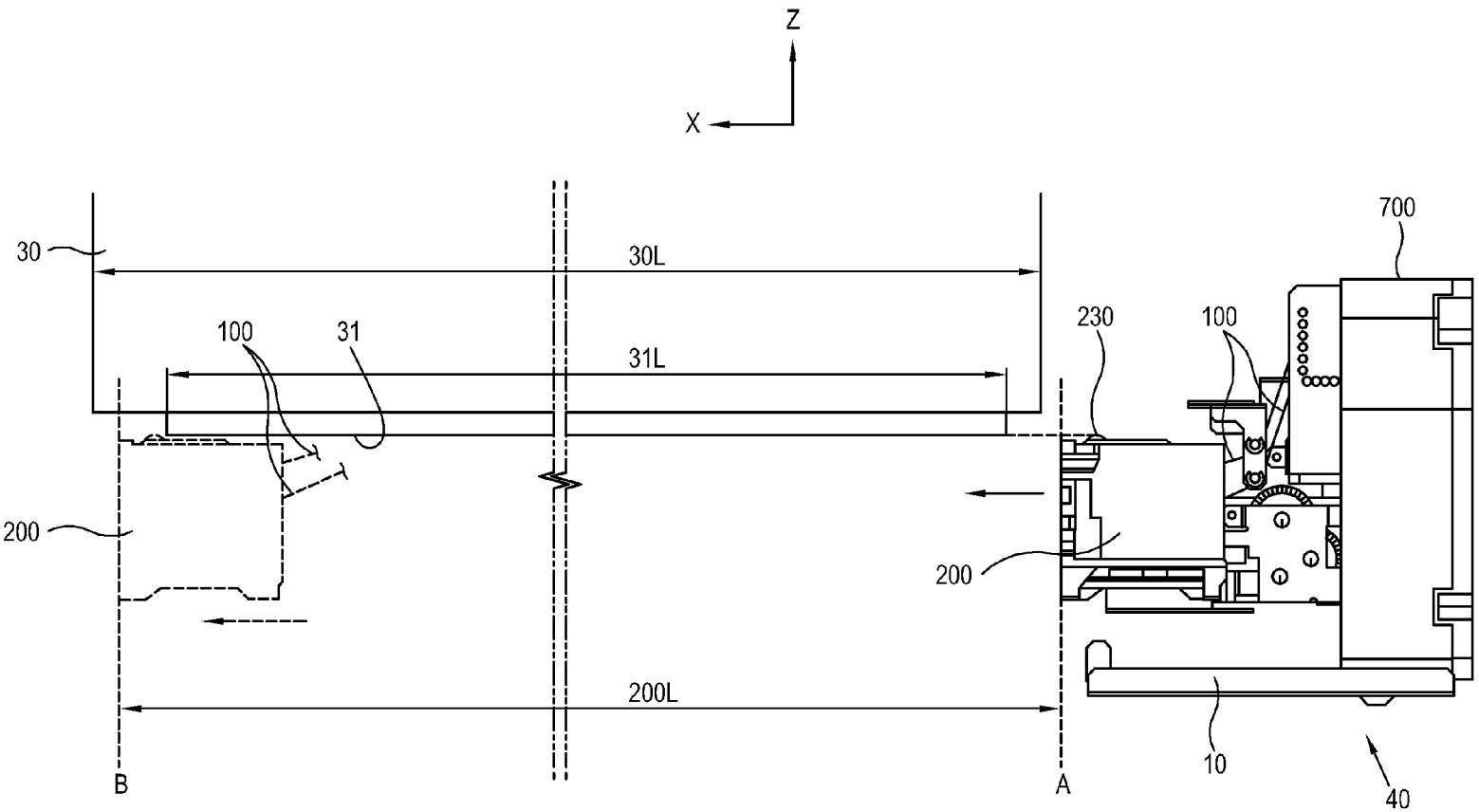
FIG. 3 is a front view illustrating a movement of a transfer shuttle in the wiping assembly of FIG. 2.

FIG. 3 is a view illustrating a movement of the transfer shuttle 200 when the nozzles 31 of a nozzle unit formed on the image forming cartridge 30 to eject ink therethrough are wiped. Here, the nozzle unit may include a plurality of chips each having the nozzles 31, and the plurality of chips are arranged in a longitudinal direction of the image forming cartridge 30 or the nozzle unit. The transfer shuttle 200 may move in the longitudinal direction of the image forming cartridge 30 or the nozzle unit. Since the plurality of chips of the nozzle unit are well known, detail descriptions thereof will be omitted.

As illustrated in FIG. 3, the transfer shuttle 200 moves between a standby position A and a return position B which may be previously set according to arrangement of the nozzles 31 or a longitudinal direction of the nozzle unit of the image forming cartridge. Here, the standby position A and the return position B are set to one end and the other end of the nozzles 31 sequentially arranged along the X direction, respectively.

The standby position A is a position where the transfer shuttle 200 is on standby while the wiping process is not performed. In the standby position A, the transfer shuttle 200, the wiping sheet 100 or the like are not interfered with image formation of the image forming cartridge 30 and a movement (or feeding) of the print medium during the printing job. However, the standby position A is close to the nozzle 31 so that the wiping can be performed by the wiping sheet 100 as soon as the wiping process begins. In this embodiment, the standby position A is set near a right side of the nozzle 31.

If the main frame 10 include a plate to support the print medium with respect to the nozzle unit of the image forming cartridge 30 so that ink ejected from the nozzles of the nozzle unit of the image forming cartridge 30 reaches the print medium, the plate may be disposed not to interfere with the movement of the wiping sheet 100 in the wiping process or the plate may move between a first position where the plate is disposed to support the printing medium with respect to the nozzles 31 in a printing job, and a second position where the plate is disposed away from the first position and the nozzle unit to provide a space to the transfer shuttle 200 and/or the wiping sheet 100 such that a movement of the transfer shuttle 200 is not interfered with the plate in the wiping process. The plate may be disposed at a location to support the print medium and also not to interfere with the transfer shuttle 200.

The return position B is a position where the transfer shuttle 200 moving in the X direction along the sequentially arranged nozzles 31 passes through the last nozzle 31. The transfer shuttle 200 returns from the return position B to the standby position A in the -X direction.

When the wiping process begins, the transfer shuttle 200 moves from the standby position A in the X direction. At this time, the pressing member 230 brings the wiping sheet 100 into contact with the nozzle 31, thereby performing the wiping. When the transfer shuttle 200 reaches the return position B, the wiping is completed with respect to all nozzles 31. Then, the transfer shuttle 200 moves in the -X direction and returns to the standby position A.

When the image forming cartridge 30 has a length 30L in a longitudinal direction, for example, in the X direction, the nozzle unit may have a length 31L in the X direction, and a distance between the standby position A and the return position B of the transfer shuttle may be a length 200L. Here, the length 200L may be shorter than the length 30L and 31L, and the length 31L may be shorter than the length 30L and longer than 200L. However, the present general inventive concept is not limited thereto. The lengths 30L, 31L and 200L may be changed according to characteristics of the wiping assembly 40 and wiping operations of the wiping process of the transfer shuttle 200 with respect to the image forming cartridge 30.

Below, the structure of the transfer shuttle 200 will be described with reference to FIG. 4.

Figure 4:
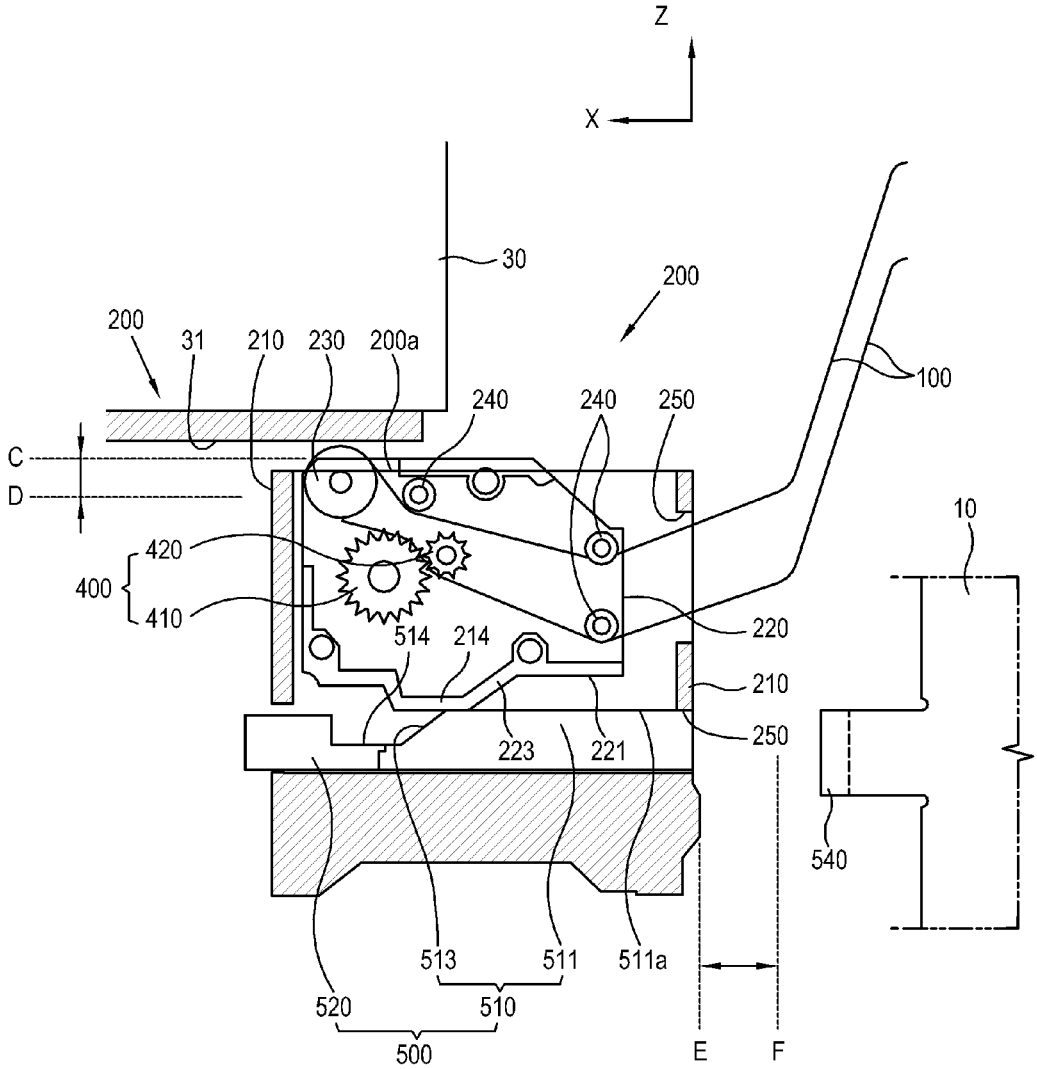
FIG. 4 is a lateral section view illustrating a structure of the transfer shuttle when a second shuttle frame is in a press position.

FIG. 4 schematically shows the transfer shuttle 200.

The transfer shuttle 200 includes a first shuttle frame 210, a second shuttle frame 220 mounted to the first shuttle frame 210 and movable up and down with respect to the nozzle unit, and the pressing member 230 installed in the second shuttle frame 220. The first shuttle frame 210 and the second shuttle frame 220 include an opening 250 through which the wiping sheet 100 or the like can pass.

Also, to prevent the wiping sheets 100 from interfering with each other or to prevent an undesired region of the wiping sheet 100 from approaching the nozzle 31, a plurality of idle rollers 240 may be provided in the second shuttle frame 220.

The first shuttle frame 210 moves between the standby position A and the return position B. The first shuttle frame 210 is internally formed with a space to accommodate the second shuttle frame 220, so that the accommodated second shuttle frame 220 can move up and down within the first shuttle frame 210.

The second shuttle frame 220 is supported inside the first shuttle frame 210 and movable up and down in the Z direction. The second shuttle frame 220 has a top opening defined by a portion of the second shuttle frame 220 to face the nozzle 31, and the pressing member 230 is installed in a top opening 200*a*, thereby allowing the wiping sheet 100 to contact the nozzle 31 through the top opening 200*a*.

The pressing member 230 may have a curved surface surrounded with the wiping sheet 100, and presses the wiping sheet 100 against the nozzle 31, thereby performing the wiping. That is, only a region (portion) of the wiping sheet 100 interposed between the pressing member 230 and the nozzle 31 is used to perform the wiping.

Meanwhile the wiping assembly 40 includes a wiping sheet support unit 400 installed in the second shuttle frame 220 and restricting the move of the wiping sheet 100, and a frame position shifting unit 500 selectively moving the second shuttle frame 220 up and down.

Below, the wiping sheet support unit 400 will be described.

The wiping sheet support unit 400 supports a region (portion) of the wiping sheet 100 pressed by the pressing member 230 while the nozzle 31 is wiped. That is, the wiping sheet support unit 400 restricts a region of the wiping sheet 100 positioned on the pressing member 230 not to move while the first shuttle frame 210 moves. Thus, only one region of the wiping sheet 100 is used in performing the wiping during the once wiping, so that the wiping sheet 100 can be prevented from excessively wasting during the wiping.

The wiping sheet support unit 400 may use various methods of restricting or controlling the movement of the wiping sheet 100 with respect to the pressing member 230 or the first shuttle frame 210 or the nozzles 31 of the nozzle unit. For example, the pressing member 230 may be configured to restrict the movement of the wiping sheet 100. In this embodiment, a configuration separate from the pressing member 230 supports the wiping sheet 100 so as to restrict the movement of the wiping sheet 100, but the present general inventive concept is not limited thereto. The above-describe configuration may not be included in the transfer shuttle.

In the meantime, the first shuttle frame 210 moves in the X direction while the wiping is performed, and thus a frictional force may be generated between the nozzle 31 and the wiping sheet 100 in the -X direction. This frictional force may cause a portion of the wiping sheet 100 disposed between the pressing member 230 and the nozzle unit to slip or move with respect to the pressing member 230 or the second shuttle frame 220 in the -X direction which is opposite to the moving direction of the transfer shuttle 200. Thus, the wiping sheet support unit 400 applies tension to the wiping sheet 100 in a direction opposite to the frictional force, thereby preventing the wiping sheet 100 from slipping with respect to the pressing member 230 or the second shuttle frame 220.

The wiping sheet support unit 400 includes a first support gear 410 and a second support gear 420 provided in the second shuttle frame 220 and meshing with each other. The wiping sheet 100 passes between toothed parts of the first and second support gears 410 and 420 that mesh with each other, so that the movement of the wiping sheet 100 can be restricted. However, the present general inventive concept is not limited thereto. Alternatively, a plurality of rubber rollers may be used as the wiping sheet support unit 400 to form a nip therebetween through which the wiping sheet 100 passes and where a tension can be applied to the wiping sheet 100 to restrict the movement of the wiping sheet 100 with respect to the first shuttle frame 210 or the second shuttle frame 220.

Thus, the wiping sheet support unit 400 is used in restricting the movement of the wiping sheet 100 during the wiping.

Below, the frame position shifting unit 500 will be described.

In this embodiment, the first shuttle frame 210 moves in the X direction from the standby position A toward the return position B, and returns in the -X direction from the return position B toward the standby position A (refer to FIG. 3). The nozzle 31 may be wiped when the transfer shuttle 200 moves in a wiping operation of the wiping process from the standby portion A to the return position B, and the nozzle 31 may not be wiped when the transfer shuttle 200 moves in a non-wiping operation of the wiping process from the return position B to the standby portion A since the wiping has already been performed.

Thus, when the first shuttle frame 210 moves toward the return position B, the pressing member 230 moves up to a position to control the wiping sheet 100 to come into contact with the nozzle 31. On the other hand, when the first shuttle frame 210 returns to the standby position A, the pressing member 230 becomes separated from the nozzle 31 so as not to perform the wiping.

To this end, the second shuttle frame 220 may move between a press position C, at which the pressing member 230 can press the wiping sheet 100 against the nozzle 31, and a separate position D has a distance with the pressing position C. FIG. 4 shows that the second shuttle frame 220 is in the pressing position C.

The frame position shifting unit 500 supports the second shuttle frame 220 to move up and down and to stay at the press position C or the separate position D.

Specifically, the frame position shifting unit 500 makes the second shuttle frame 220 stay at the press position C when the first shuttle frame 210 moves from the standby position A to the return position B, and makes the second shuttle frame 220 move to the separate position D when the shuttle frame 210 reaches the return position B. Further, the frame position shifting unit 500 makes the second shuttle frame 220 stay at the separate position D when the first shuttle frame 210 moves from the return position B to the standby position A.

Also, the frame position shifting unit 500 moves the second shuttle frame 220 to the press position C when the first shuttle frame 210 reaches the standby position A. Thus, the nozzle 31 can be immediately wiped without moving the second shuttle frame 220 to the press position C in the next wiping process.

In this embodiment, the frame position shifting unit 500 includes a position determining member 510 movably mounted to the first shuttle frame 210, and a locking member 520 for locking and releasing the position determining member 510.

The position determining member 510 is provided in the first shuttle frame 210 and moves between a forward position E where the second shuttle frame 220 is supported to stay at the press position C and a backward (retreat) position F where the second shuttle frame 220 is supported to stay at the separate position D.

In this embodiment, the position determining member 510 is arranged under the second shuttle frame 220. When the position determining member 510 moves forward in the X direction and supports a lower side of the second shuttle frame 220, the second shuttle frame 220 moves up in the Z direction. In this state, the second shuttle frame 220 is supported by the position determining member 510 and thus stays at the press position C.

The position determining member 510 includes a position determining main body 511, and an inclined part 513 formed at an end part of the position determining main body 511, so that the second shuttle frame 220 can easily move up with respect to the first shuttle frame 210.

The position determining member 510 may further include a recess portion 514 and a surface 511*a* higher than the recess portion 514, and the inclined part 513 is formed between the surface 511*a* and the recess portion 514. The second shuttle frame 220 may include a surface 221, a protruding portion 224, and another inclined part 223 formed between the surface 221 and the protruding portion 224. The protruding portion 224 may be disposed on at least one of the surface 511*a*, the inclined part 513, and the recess portion 514 according to a movement of the transfer shutter 200 with respect to the main frame 10. The recess portion 514 may provide a space to accommodate the protruding portion 224 of the second shuttle frame 220 when the second shuttle frame 200 is disposed at the position D. Accordingly, the recess portion 514 and the protruding portion 224 may have a similar or same shape to correspond to each other. The inclined part 513 may correspond to the another inclined part5 223 and may have an similar or same inclined angle.

The locking member 520 locks the position determining member 510 so that the position determining member 510 can stay at the forward position E. Thus, the second shuttle frame 220 can stay at the press position c during the wiping.

Meanwhile, the frame position shifting unit 500 further includes a position determining member pressing unit 540 to press and move the position determining member 510 to the forward position E when the first shuttle frame 210 is on the standby position A. When the first shuttle frame 210 returns from the return position B to the standby position A, the second shuttle frame 220 is on the separate position D. When the first shuttle frame 210 reaches the standby position A, the position determining member pressing unit 540 coupled to the main body frame 10 presses the position determining member 510, and thus the position determining member 510 moves to the forward position E.

Figure 5:
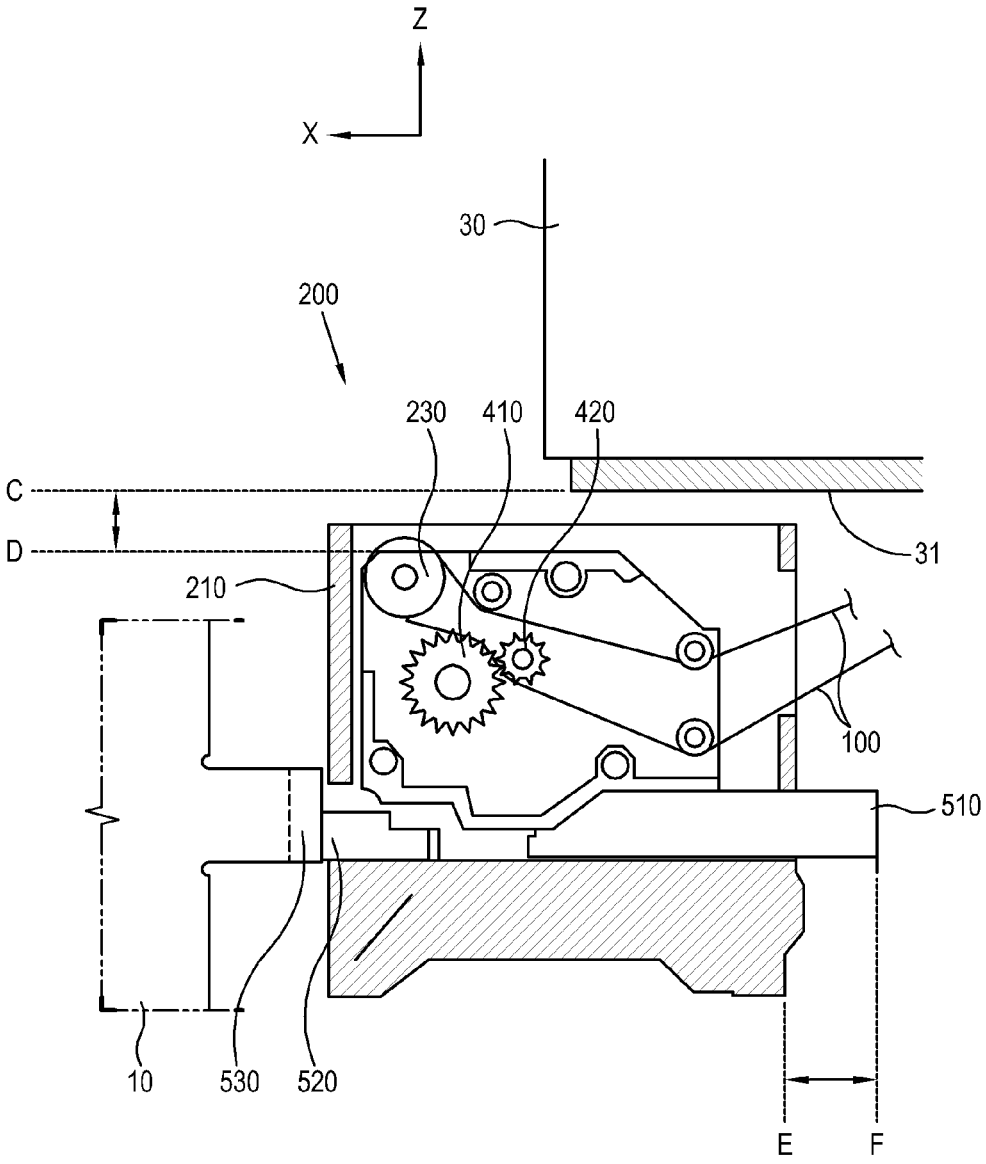
FIG. 5 is a lateral sectional view illustrating a structure of the transfer shuttle when the second shuttle frame is in a separate position.

FIG. 5 is a lateral sectional view illustrating a structure of the transfer shuttle 200 when the second shuttle frame 220 is in the separate position D.

When the first shuttle frame 210 reaches the return position B, the wiping is completed with respect to all nozzles 31. The wiping may not be preformed when the first shuttle frame 210 returns from the return position B to the standby position A, and therefore the second shuttle frame 220 moves down from the press position C to the separate position D.

Here, the frame position shifting unit 500 further includes a locking member pressing unit 530 to press the locking member 520 when the first shuttle frame 210 is on the return position B.

The locking member pressing unit 530 is installed in the main body frame 10, and presses the locking member 520 to release the position determining member 510.

The position determining member 510 released from the locking member 520 moves from the forward position E to the backward position F. Then, the position determining member 510 cannot support the second shuttle frame 220 being on the press position C, so that the second shuttle frame 220 moves down toward the separate position D. Thus, the pressing member 230 and the wiping sheet 100 are also separated from the nozzle 31.

Here, the second shuttle frame 220 may move down by its own weight. Alternatively, a separate elastic member (not illustrated) may be provided to elastically urge (or bias) the second shuttle frame 220 to move down.

Below, the configurations of the position determining member 510 and the locking member 520 will be described in more detail with reference to FIG. 6.

Figure 6:
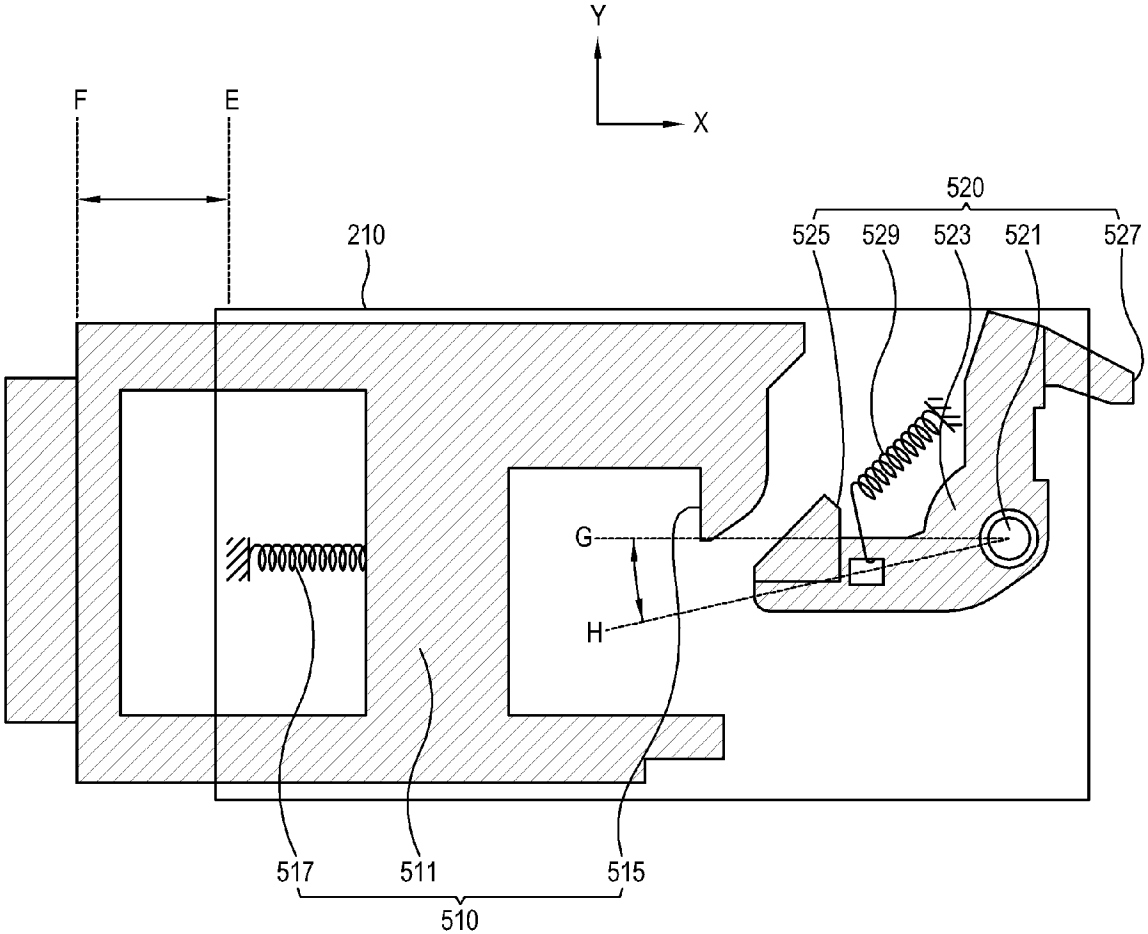
FIG. 6 is a rear view illustrating a structure of a position determining member and a locking member from a bottom view of a first shuttle frame of FIG. 5.

FIG. 6 is a rear view showing a structure of the position determining member 510 and the locking member 520 from a bottom view of the first shuttle frame 210 of FIG. 5.

As illustrated in FIG. 6, the position determining member 510 includes a position determining main body 511, a protrusion 515 formed in an X directional end part of the position determining main body 511, and a position determining elastic member 517 to elastically press (bias) the position determining main body 511 toward the backward position F.

Meanwhile, the locking member 520 includes a locking member rotating shaft 521 coupled to the first shuttle frame 210, a locking main body 523 rotating with respect to the locking member rotating shaft 521, a locking unit 525 formed in one end part of the locking main body 523 corresponding to the protrusion 515 and rotating between a locking position G and a releasing position H, a press part 527 formed in the other end part of the locking main body 523 corresponding to the locking member pressing unit 530, and a locking elastic member 529 to elastically press (or bias) the locking main body 523 so that the locking unit 525 can be on the locking position G.

At an initial state, the locking unit 525 is on the locking position G by elasticity of the locking elastic member 529. If the position determining member 510 overcomes elasticity of the position determining elastic member 517 and moves to the forward position E, the protrusion 515 is locked to the locking unit 525. The locking unit 525 restricts the position determining main body 511 from moving to the backward position F by elasticity of the position determining elastic member 517.

Thus, the position determining member 510 can stay at the forward position E.

In the meantime, when the locking member pressing unit 530 presses the press part 527, a moving force of the locking main body 523 overcomes the elasticity (elastic force) of the locking elastic member 529 and rotates. As the locking main body 523 rotates, the locking unit 525 rotates to the releasing position H, so that the locking unit 525 can be released from the protrusion 515. Then, the elasticity of the position determining elastic member 517 acts to move the position determining main body 511 to the reward position F.

When the pressure of the locking member pressing unit 530 is released, the locking main body 523 is rotated by the elasticity of the locking elastic member 529 and the locking unit 525 is rotated the locking position G.

As describe above, the wiping sheet support unit 400 restricts the move of the wiping sheet 100 while the wiping process is performed. The wiping sheet 100 used in the previous wiping process is used again for the next wiping process. However, the present general inventive concept is not limited thereto. It is possible that the wiping sheet 100 used in the previous wiping process ma not be used again for the next wiping process.

Accordingly, the wiping assembly 40 includes a wiping sheet moving unit 600 that makes the region of the wiping sheet 100 pressed by the pressing member 230 move as much as a predetermined section, according to a preset period of the wiping process. Below, configurations of the wiping sheet moving unit 600 will be described with reference to FIGS. 7 and 8.

Figure 7:
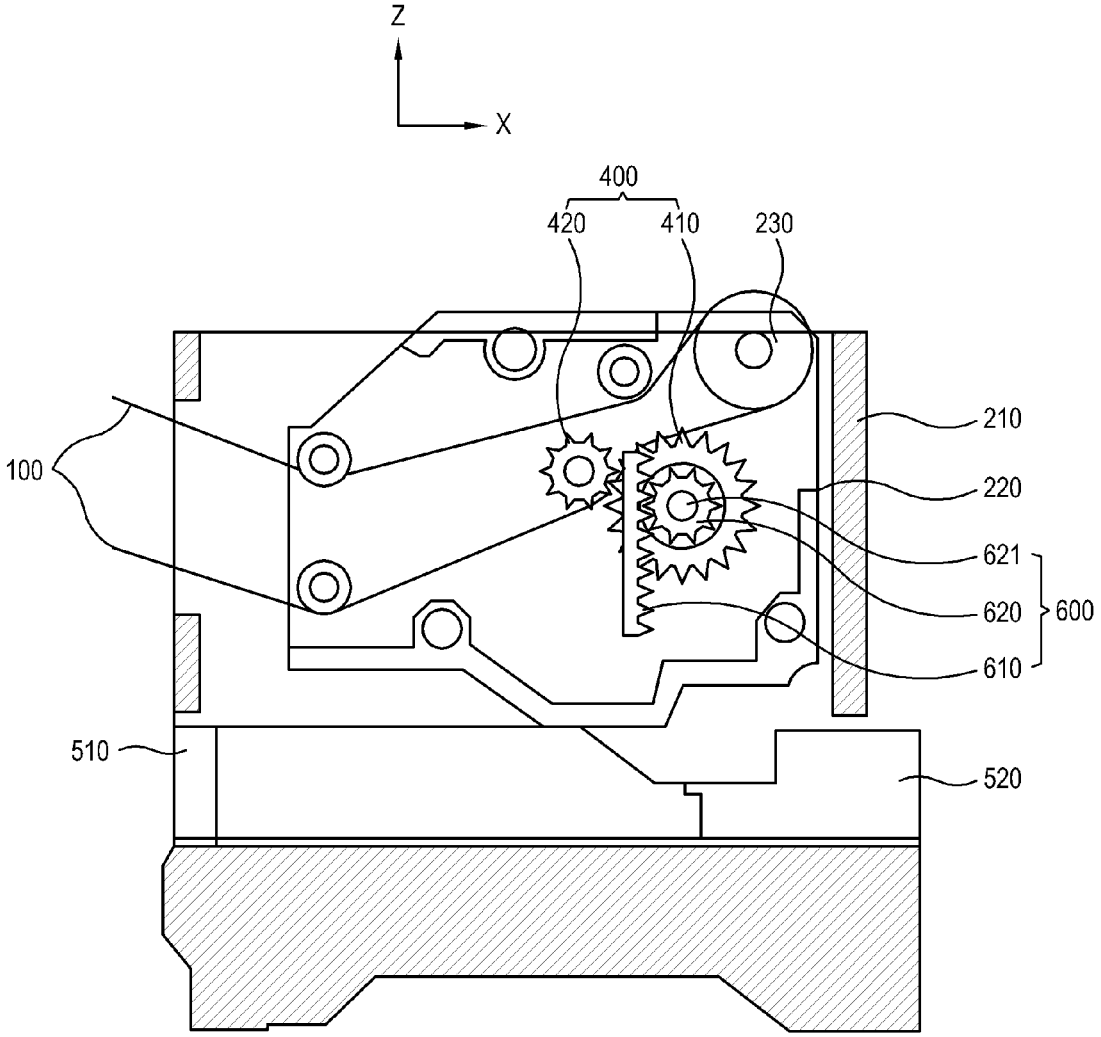
FIG. 7 is a lateral section view illustrating a structure where a wiping sheet moving unit is applied to the transfer shuttle of FIG. 4.
Figure 8:
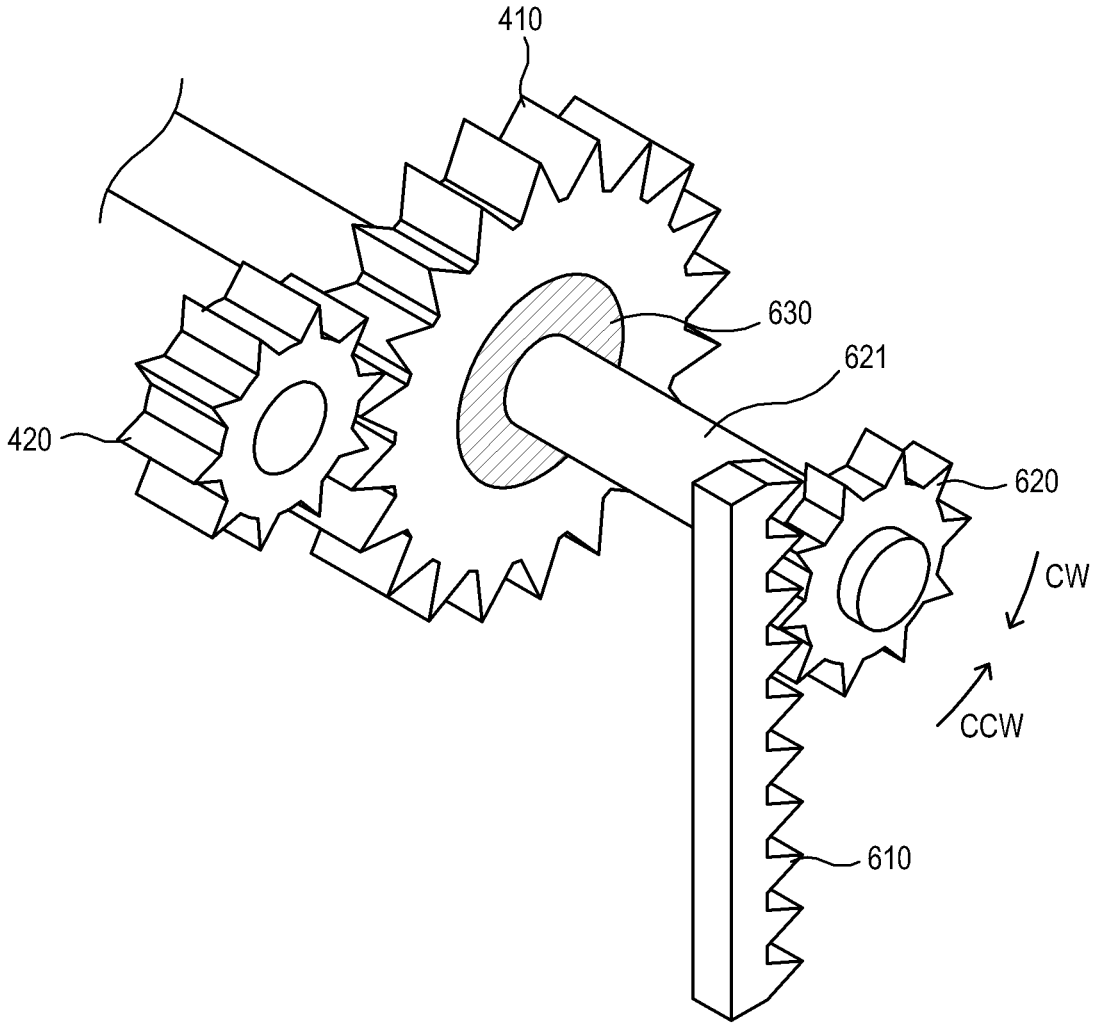
FIG. 8 is a partial perspective view illustrating a structure of the wiping sheet moving unit and a wiping sheet supporting unit in FIG. 7.

FIG. 7 is a lateral section view of a structure where the wiping sheet moving unit 600 is applied to the transfer shuttle 200 of FIG. 4, and FIG. 8 is a partial perspective view showing a structure of the wiping sheet moving unit 600 and the wiping sheet support unit 400 in FIG. 7.

As illustrated in FIGS. 7 and 8, the wiping sheet moving unit 600 includes a rack gear 610 installed in the first shuttle frame 210 and having a toothed part formed along the moving direction of the second shuttle frame 220, a pinion gear 620 installed in the second shuttle frame 220 and corresponding to the rack gear 610, and a one-way clutch 630 selectively transmitting a rotational force of the pinion gear 620 to the first support gear 410.

The pinion gear 620 is installed on a rotating shaft 621 coaxial with the first support gear 410, and the one-way clutch 630 is interposed between the first support gear 410 and the rotating shaft 621.

The second shuttle frame 220 moves from the separate position D to the press position C. That is, if the second shuttle frame 220 moves up in the Z direction, the pinion gear 620 rotates by the rack gear 610 in a counterclockwise direction CCW.

Here, the first support gear 410 is coaxially connected to the pinion gear 620, so that the first support gear 410 can interlock with the rotational force of the pinion gear 620 and rotate in the counterclockwise direction CCW. As the first support gear 410 supporting the wiping sheet 100 rotates in the counterclockwise direction CCW, the region of the wiping sheet 100 pressed by the pressing member 230 moves as much as a predetermined section, and a region of the wiping sheet 100 not used in the wiping moves to a position to be pressed by the pressing member 230.

In this case, the one-way clutch 630 transmits the rotational force of the rotating shaft 621 to the first support gear 410.

On the other hand, when the second shuttle frame 220 moves from the press position C to the separate position D. For example, the second shuttle frame 220 moves down in the -Z direction, and thus the pinion gear 620 rotates in a clockwise direction CW.

When the first support gear 410 interlocks with the pinion gear 620 to rotate in the clockwise direction CW, the region of the wiping sheet 100 already used in the wiping may return to the position to be pressed by the pressing member 230.

Thus, the one-way clutch 630 cuts off the rotational force of the rotating shaft 621 from being transmitted to the first support gear 410, thereby preventing the region of the wiping sheet 100 already used in the wiping from returning.

The wiping sheet moving unit 600 moves the wiping sheet 100 by rotating the first support gear 410 when the second shuttle frame 220 moves up, and thus makes a new region of the wiping sheet 100 be positioned corresponding to the pressing member 230. On the other hand, the wiping sheet moving unit 600 cuts off the first support gear 410 from rotating when the second shuttle frame 220 moves down, and thus restricts the move of the wiping sheet 100.

Thus, every time when the wiping process is performed, a new region of the wiping sheet 100 is used in the wiping.

Below, a wiping sheet storage unit 700 where the wiping sheet 100 supplied to or collected from the transfer shuttle 200 is stored will be described with reference to FIG. 9.

Figure 9:
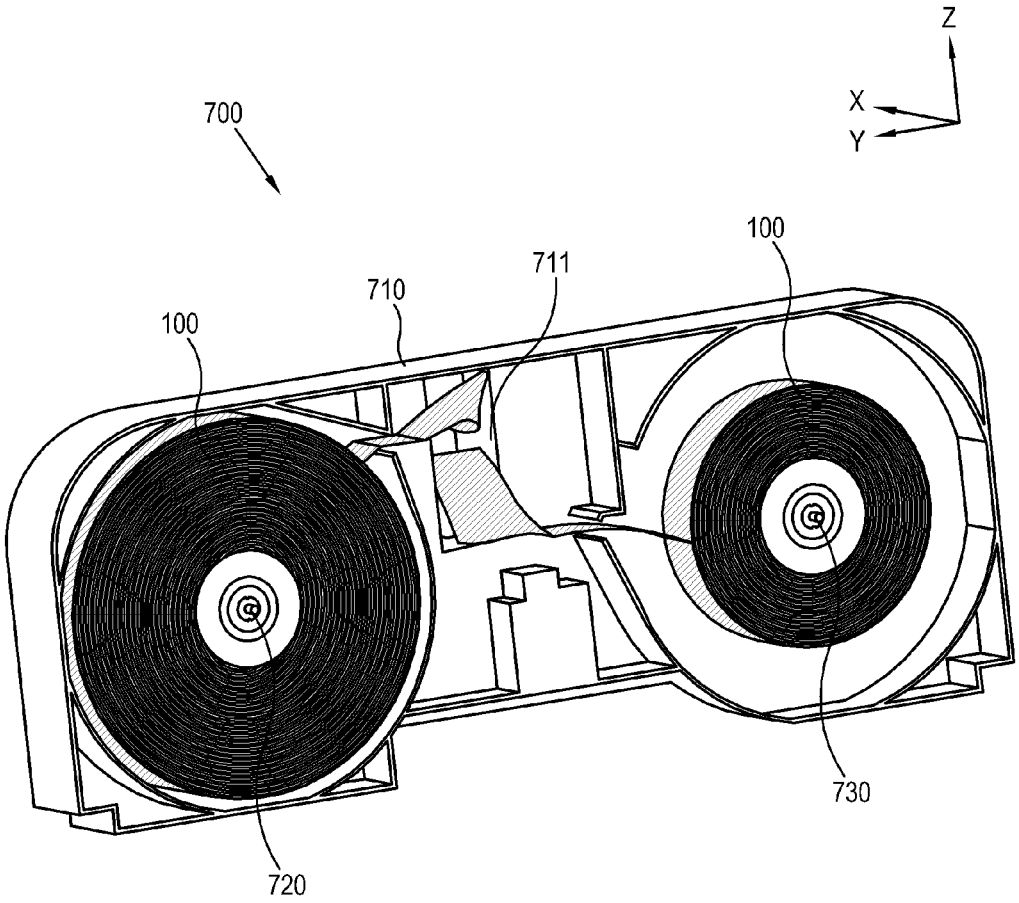
FIG. 9 is a partial perspective view illustrating a wiping sheet storage unit in the wiping assembly of FIG. 2.

FIG. 9 is a partial perspective view showing the wiping sheet storage unit 700 in the wiping assembly of FIG. 2.

As illustrated in FIG. 9, the wiping sheet storage unit 700 includes a storage unit housing 710 coupled to the main body frame 10, a supplying-side reel 720 provided in at a side of the storage unit housing 710, and a collecting-side reel 730 provided separately from the supplying reel 720.

The storage unit housing 710 stores one side of the wiping sheet 100 not used in the wiping and the other side already used in the wiping. That is, the wiping sheet 100 is shaped like a belt, in which the unused wiping sheet 100 is wound around the supplying-side reel 720 but the wiping sheet 100 used in the wiping is wound around the collecting-side reel 730. Although it is not shown, the supplying-side reel 720 and the collecting-side reel 730 are provided with a power transmission gear to receive power (driving force) from the driving unit 1640 of FIG. 14 for winding the wiping sheet 100 thereon.

The wiping sheet 100 wound around the supplying-side reel 720 and the wiping sheet 100 wound around the collecting-side reel 730 are not separated from each other, but connected through the transfer shuttle 200. The supply and the collection of the wiping sheet 100 are performed as the wiping sheet 100 moves through an opening 711 formed in the storage unit housing 710.

Here, the wiping sheet storage unit 700 is provided substantially perpendicularly to the moving direction of the transfer shuttle 200. That is, each radial direction of the supplying-side reel 720 and the collecting-side reel 730, i.e., the radial directions where the wiping sheet 100 is wound is substantially perpendicular to the moving direction of the transfer shuttle 200. Thus, the storage unit housing 710 can be installed so that a longitudinal direction can be in parallel with the moving direction of the print medium, thereby to minimize the image forming apparatus 1.

Suppose that the transfer shuttle 200 moves from the standby position A to the return position B. At this time, the supplying-side reel 720 and the collecting-side reel 730 are disconnected from a driving force, so that the wiping sheet 100 can be released from the supplying-side reel 720 and the collecting-side reel 730 as the transfer shuttle 200 moves.

On the other hand, if the transfer shuttle 200 moves from the return position B to the standby position A, the supplying-side reel 720 and the collecting-side reel 730 are connected to the driving force, so that the supplying-side reel 720 and the collecting-side reel 730 can spin in a direction for winding the wiping sheet 100 therearound, respectively, and thus wind the wiping sheet 100 released when the transfer shuttle 200 moves to the return position B.

However, because the amount of the wiping sheet 100 wound around the supplying-side reel 720 and the collecting-side reel 730 is varied depending on progress of wiping process, the rotational radii of the wiping sheet 100 winding around the supplying-side reel 720 and the collecting-side reel 730 are changed. In other words, as the wiping process is repeated, the amount of the wiping sheet 100 wound around the supplying-side reel 720 decreases gradually but the amount of the wiping sheet 100 wound around the collecting-side reel 730 increases gradually.

Therefore, before the transfer shuttle 200 reaches the standby position A, either of the supplying-side reel 720 or the collecting-side reel 730, around which more wiping sheet 100 is wound, completes the winding of the wiping sheet first. For example, if the amount of the wiping sheet 100 wound around the supplying-side reel 720 is more than that around the collecting-side reel 730, the supplying-side reel 720 completes the winding of the wiping sheet 100 at a predetermined point of time before the transfer shuttle 200 reaches the standby position A.

Thereafter, as the transfer shuttle 200 continues to move toward the standby position A, no more wiping sheet 100 can be wound around the supplying-side reel 720 while the collecting-side reel 730 performs the winding. At this time, if the driving force continuously acts to the supplying-side reel 720 and the collecting-side reel 730, an excessive load is applied to the supplying-side reel 720, thereby causing a trouble.

To prevent this, the supplying-side reel 720 and the collecting-side reel 730 are configured to idly spin if receiving a load more than a preset value while winding the wiping sheet therearound. In the foregoing example, if the supplying-side reel 720 cannot wind the winding sheet 100 any more, the supplying-side reel 720 spin idly until the collecting-side reel 720 completes the winding and is then disconnected from the driving force. Thus, the supplying-side reel 720 stops winding the wiping sheet 100 therearound. Likewise, the same principle can be applied even when the amount of the wiping sheet 100 wound around the collecting-side reel 730 is more than that around the supplying-side reel 720.

To this end, the supplying-side reel 720 and the collecting-side reel 730 may be achieved by a torque limiter, but not limited thereto. The torque limiter includes a driving shaft to receive a driving force, a driven shaft to interlock with the driving shaft, and a slip mechanism to allow the driving shaft to slip over the driven shaft if a force acting between the driving shaft and the driven shaft is equal to or higher than a predetermined value. The slip mechanism may include viscous oil, a spring having elasticity, a frictional member having a predetermined friction, etc.

If a force repulsive against the operation of the driving shaft acts on the driven shaft, and the force is equal to or higher than a predetermined value, the driving shaft slips over the driven shaft through the slip mechanism. Thus, the driven shaft of the reels 701 does not rotate even though the driving shaft of the driving unit rotates. On the other hand, the force is less than the predetermined value, the driven shaft interlocks with the driving shaft.

In the embodiment, the wiping assembly 40 further includes a power transmission control unit 800 so that the supplying-side reel 720 and the collecting-side reel 730 are selectively connected to or disconnected from the driving force.

Below, the configurations of the power transmission control unit 800 will be described with reference to FIGS. 10 and 11.

Figure 10:
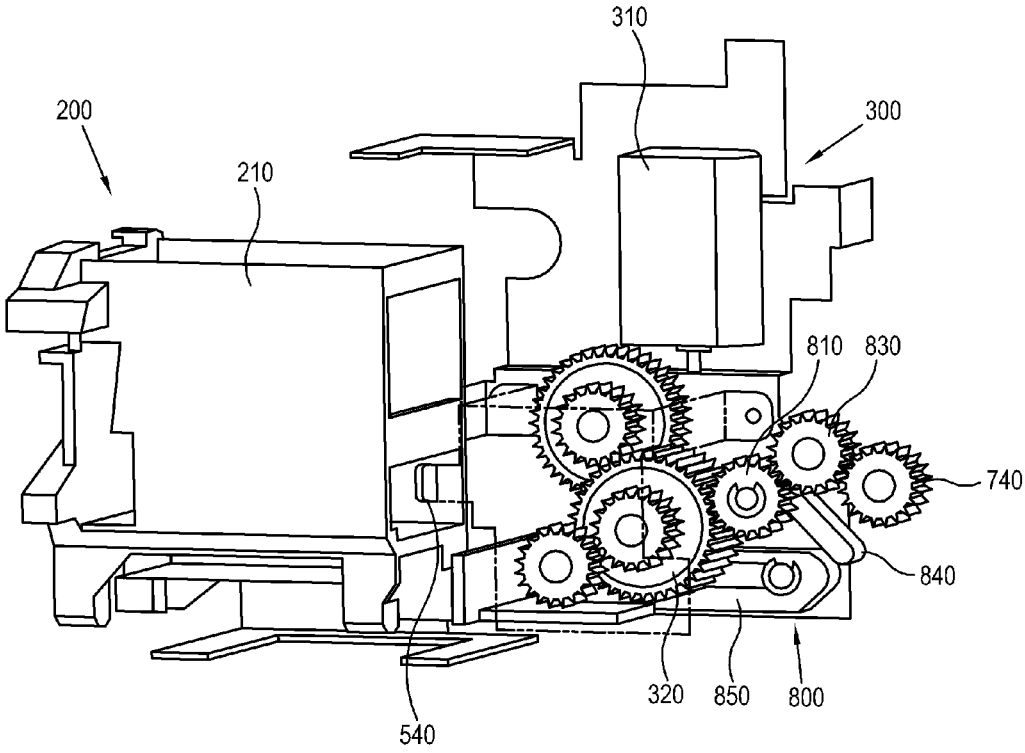
FIG. 10 is a partial perspective view illustrating a driving unit and a power transmission control unit in the wiping assembly of FIG. 2.
Figure 11:
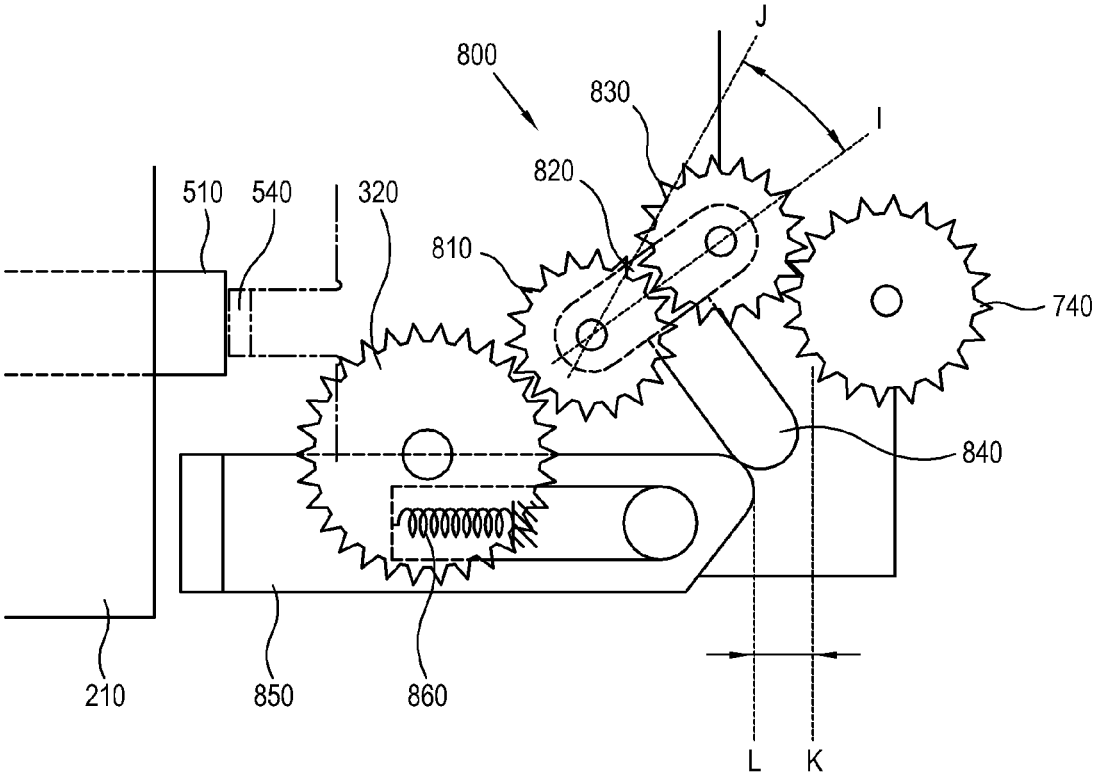
FIG. 11 is a partial plan view illustrating a structure of the power transmission control unit in FIG. 10.

FIG. 10 is a partial perspective view showing the driving unit 300 and the power transmission control unit 800, and FIG. 11 is a partial plan view schematically showing the power transmission control unit 800.

As illustrated in FIGS. 10 and 11, the wiping assembly 40 includes the driving unit 300 to provide the driving force for moving the transfer shuttle, and the power transmission control unit 800 to selectively transmit the driving force from the driving unit 300 to at least one of the supplying-side reel 720 and the collecting-side reel 730.

The driving unit 300 includes a motor 310 to generate the driving force, and a plurality of driving unit gears 320 to transmit the driving force from the motor 10 to the transfer shuttle 200.

The power transmission control unit 800 receives the driving force from the motor 310 through one of the plurality of driving unit gears 320, and controls the received driving force to be connected to or disconnected from a reel-side gear 740 interlocking with the supplying-side reel 720 and the collecting-side reel 730.

The power transmission control unit 800 includes a first control unit gear 810 meshing with the driving unit gear 320, a first control unit link 820 having one end rotatable with respect to the rotating shaft of the first control unit gear 810, and a second control unit gear 830 installed at the rotatable end of the first control unit link 820 while meshing with the first control unit gear 810.

Whether or not the power transmission control unit 800 transmits the driving force is determined depending on the moving direction of the transfer shuttle 200 and a corresponding operation of the motor 310.

If the motor 310 operates forward (or in a first direction), the transfer shuttle 200 moves from the standby position A to the return position B. On the other hand, if the motor 310 operates backward (or in a second direction), the transfer shuttle 200 moves from the return position B to the standby position A. Here, "forward" and "backward" are just used for convenience to distinguish the operations of the motor 310.

In each case, the power transmission control unit 800 controls the selective transmission of the driving force as follows.

When the motor 310 operates forward, the driving unit gear 320 rotates clockwise in FIG. 11. Thus, the first control unit gear 810 rotates counterclockwise, and the second control unit gear 830 also starts rotating while meshing with the first control unit 810. However, since the second control unit gear 830 is installed on the first control unit link 820, in this case, one end of the first control unit link 820 provided with the second control unit gear 830 rotates with respect to the rotating shaft of the first control unit gear 810.

Thus, the first control unit link 820 rotates to a gear separate position J where the second control unit gear 830 is separated from the reel-side gear 740. Because the second control unit gear 830 is separated from the reel-side gear 740, the reel-side gear 740 does not rotate even though the motor 310 operates to rotate the driving unit gear 320. Consequently, the supplying-side reel 720 and the collecting-side reel 730 do not rotate.

When the motor 310 operates backward, the driving unit gear 320 rotates counterclockwise in FIG. 11. Thus, the first control unit gear 810 rotates clockwise, and on the same principle, the first control unit link 820 rotates to a gear approach position I where the second control unit gear 830 is engaged with the reel-side gear 740.

Thus, the driving force is transmitted from the motor 310 to the reel-side gear 740 via the driving unit gear 320, the first control unit gear 810 and the second control unit gear 830. Then, the supplying-side reel 720 and the collecting-side reel 730 rotate according to a rotation of reel-side gear 740.

Like this, the driving force of the motor 310 can be selectively connected to or disconnected from the reel-side gear 740 in accordance with the directions where the driving unit gear 320 rotates due to the operations of the motor 310, thereby controlling the rotation of the supplying-side reel 720 and the collecting-side reel 730.

Meanwhile, the transfer shuttle 200 moves from the return position B, the position determining member pressing unit 540 starts pressing the position determining member 510 when the transfer shuttle 200 reaches the standby position A. Thus, the second shuttle frame 220 moves up to the press position C.

At this time, the driving force of the motor 310 may be disconnected from the reel-side gear 740, as follows.

If the position determining member pressing unit 540 presses the position determining member 510 and thus the second shuttle frame 220 moves up, the wiping sheet moving unit 600 makes the wiping sheet 100 move as much as a predetermined section. At this time, winding of the wiping sheet 100 around the supplying-side reel 720 is completed, so that the wiping sheet wound around the supplying-side reel 720 can be forcibly tensed. Therefore, the driving force of the motor 310 is disconnected from the reel-side gear 740 in order to prevent the wiping sheet 100 from being damaged between the supplying-side reel 720 and the wiping sheet moving unit 600.

Also, the driving force of the motor 310 of the driving unit is prevented from being transmitted to at least one of the reels 101, and the second shuttle frame 220 moves up with respect to the first shuttle frame 210.

To this end, the power transmission control unit 800 includes a second control unit link 840 extended from the first control unit link 820, and a link pressing member 850 provided in the main body frame 10 so as to be pressed by the first shuttle frame 210 that moves to the standby position A and to be movable.

As the transfer shuttle 200 moves to the standby position A, the position determining member pressing unit 540 presses the position determining member 510 and the first shuttle frame 210 presses the link pressing member 850. The link pressing member 850 pressed by the first shuttle frame 210 moves to a link press position K, and makes the second control unit link 840 move up.

As the second control unit link 840 moves up, the first control unit link 820 rotates to the gear separate position J, so that the second control unit gear 830 can be separated from the reel-side gear 740.

While the transfer shuttle 200 is in the standby position A, the link pressing member 850 is being pressed by the first shuttle frame 210, so that the second control unit gear 830 can be being separated from the reel-side gear 740.

On the other hand, if the first shuttle frame 210 does not press the link pressing member 850, an elastic member 860 elastically urges the link pressing member 850 to move to a link return position where it does not press the second control unit link 840. At this time, if the motor 310 does not operate, the first control unit link 820 rotates to the gear approach position I and the second control unit gear 830 is engaged with the reel-side gear 740.

At this time, if the motor 310 operates forward to move the transfer shuttle 200 to the return position B, the first control unit link 820 stays at the gear separate position J. On the other hand, if the motor 310 operates backward to move the transfer shuttle 200 to the standby position A, the first control unit link 820 rotates to the gear approach position I. This is based on the same principle as the foregoing embodiment, and repetitive descriptions thereof will be avoided.

Like this, if the second shuttle frame 220 moves up to the press position C when the transfer shuttle 200 reaches the standby position A, the driving force of the motor 310 is cut off or prevented from being transmitted to the reel-side gear 740.

With each configuration as described above, the wiping process performed in the wiping assembly 40 of the image forming apparatus 1 according to the embodiment will be described.

The wiping process includes a first stage where the wiping is performed at an initial state, a second stage where the transfer shuttle 200 prepares for returning at the return position B after completing the wiping, a third stage where the transfer shuttle 200 returns, and a fourth stage where the transfer shuttle 200 reaches the standby position A and prepares for the next wiping process.

Below, each stage will be described with reference to FIGS. 12 to 15. FIGS. 12 to 15 are flowcharts illustrating operations of elements at the respective stages in the wiping process performed in the image forming apparatus of FIG. 1.

The initial state is as follows.

At the initial state, the first shuttle frame 210 stays at the standby position A and the second shuttle frame 220 stays at the press position C. The position determining member 510 is pressed by the position determining member pressing unit 540 and locked by the locking member 520 so that it can stay at the forward position E.

Since the link pressing member 850 is pressed by the first shuttle frame 210, the second control unit gear 830 is separated from the reel-side gear 740. Thus, the supplying-side reel 720 and the collecting-side reel 730 are being disconnected from the driving force.

Below, the first stage where the wiping is performed will be described with reference to FIG. 12.

Figure 12:
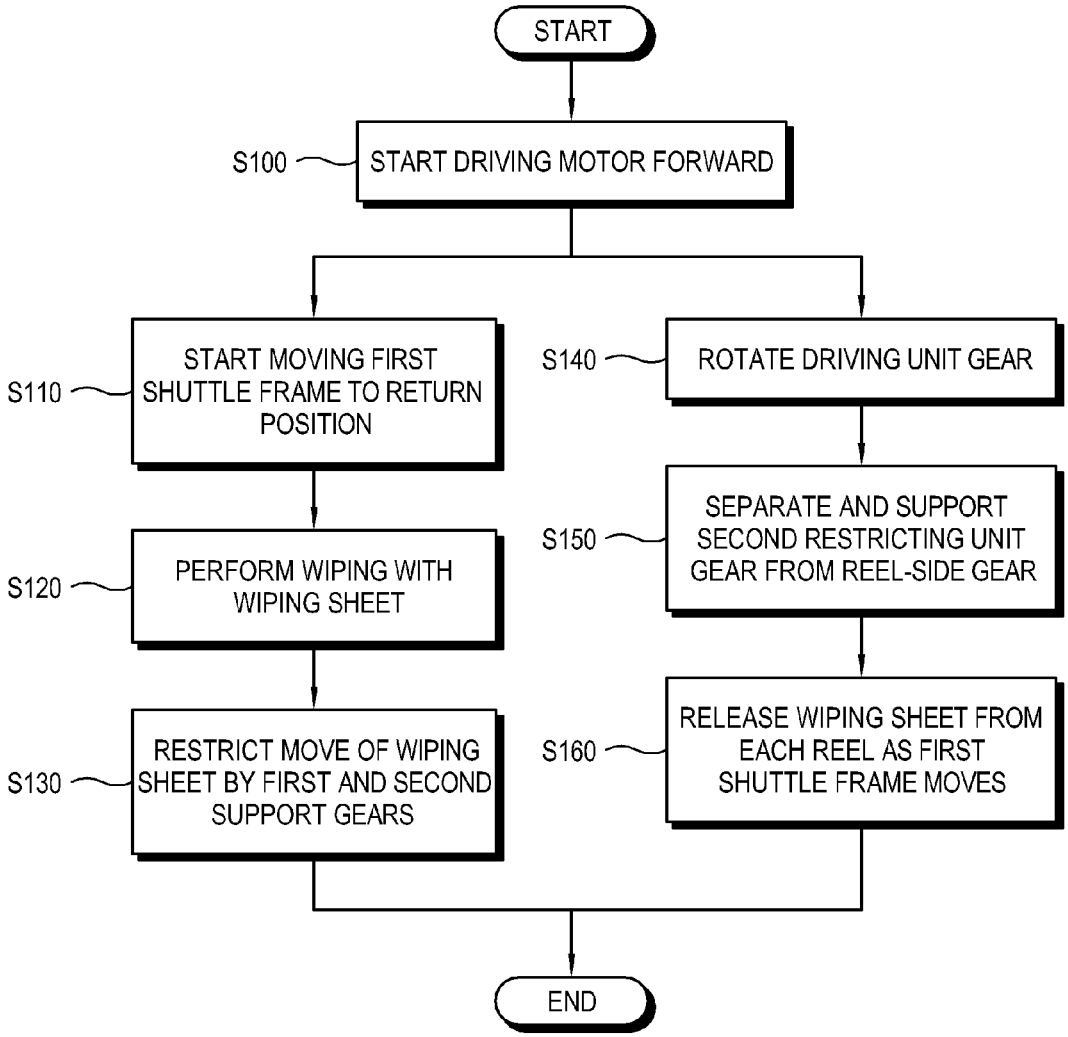
FIGS. 12, 13, 14, and 15 are flowcharts illustrating operations of a wiping process performed in the image forming apparatus of FIG. 1.

As illustrated in FIG. 12, if the motor 310 operates forward at operation S100, the first shuttle frame 210 moves from the standby position A to the return position B at operation S110.

Because the position determining member 510 is locked by the locking member 520, the second shuttle frame 220 stays at the press position C and the nozzle 31 is wiped by the wiping sheet 100 interposed between the nozzle 31 and the pressing member 230 at operation S120. At this time, the first support gear 410 and the second support gear 420 support the wiping sheet 100 so that tension can be applied in a direction opposite to friction applied to the wiping sheet 100, thereby restricting the movement of the wiping sheet 100 corresponding to the nozzle 31 while performing the wiping at operation S130.

As the driving unit gear 320 rotates at operation S140, the second control unit gear 830 is maintained as being separated from the reel-side gear 740 at operation S150, and the driving force is disconnected from the supplying-side reel 720 and the collecting-side reel 730. Thus, the whipping sheet 100 wound around the supplying-side reel 720 and the collecting-side reel 730 is released at operation S160 as the first shuttle frame 210 moves.

Figure 15:
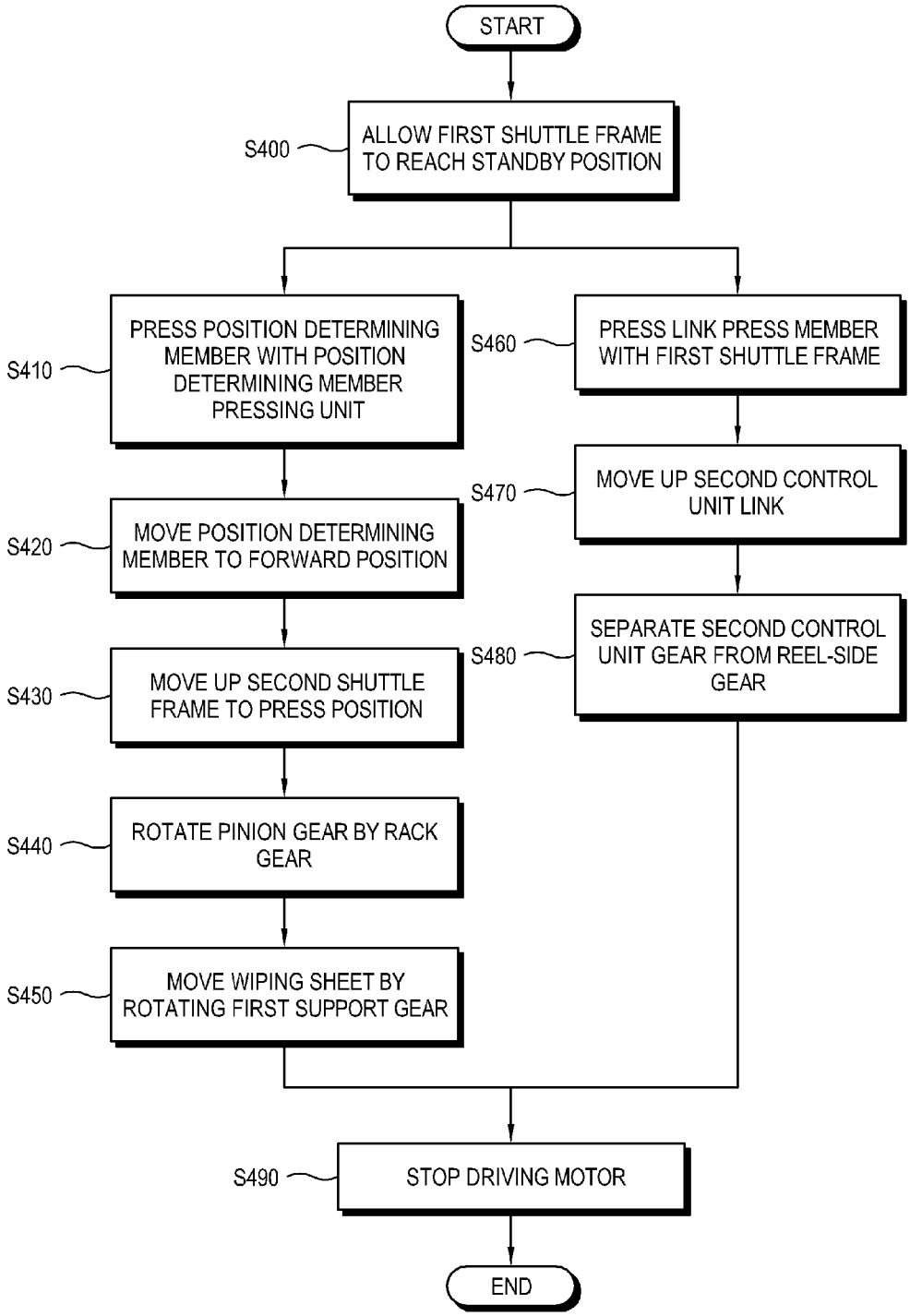

The operations S110 through S160 may be simultaneously performed according to a control of the controller 1610 of FIG. 15. However, the present general inventive concept is not limited thereto. The operations S110 through S160 can be sequentially performed. It is also possible that the operations S110 through S160 may be selectively performed according to corresponding driving forces of the driving unit 1650 of FIG. 15.

Below, the second stage where the wiping is completed will be described with reference to FIG. 13.

Figure 13:
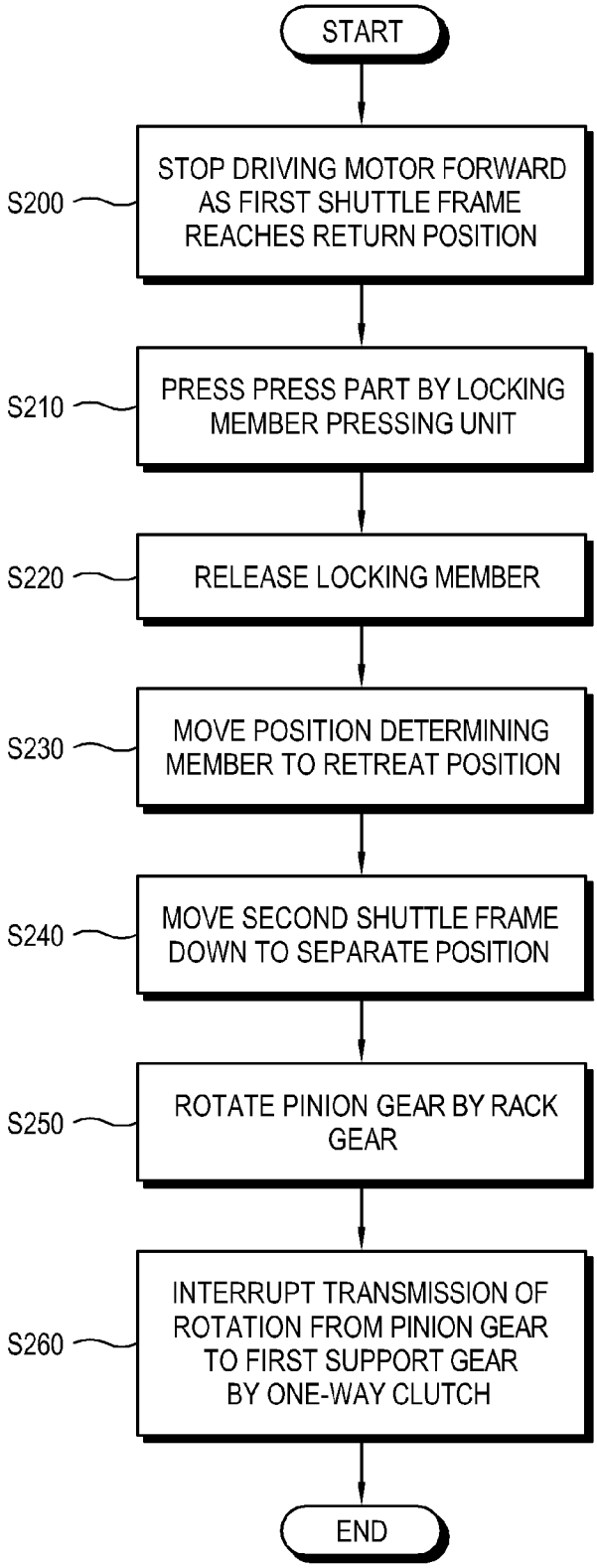

As illustrated in FIG. 13, the first shuttle frame 210 reaches the return position B, and the motor 310 stops operating forward at operation S200. Thus, the wiping is complete with regard to all nozzles 31.

As the first shuttle frame 210 reaches the return position B, the locking member pressing unit 530 presses the press part 527 at operation S210, and the locking member 520 is released from the position determining member 510 at operation S220. The position determining member 510 moves to the backward (retreat) position F at operation S230, and the second shuttle frame 220 moves down to the separate position D.

As the second shuttle frame 220 moves down, the rack gear 610 causes the pinion gear 620 to rotate at operation S250. At this time, the one-way clutch 630 cuts off the rotational force of the pinion gear 620 from being transmitted to the first support gear 410 not to rotate the first support gear 410 in cooperation with the rotation of the pinion gear 620 at operation S260. Thus, the wiping sheet 100 does not move.

The operations S200 through S260 may be simultaneously performed according to a control of the controller 1610 of FIG. 15. However, the present general inventive concept is not limited thereto. The operations S200 through S260 can be sequentially performed. It is also possible that the operations S200 through S260 may be selectively performed according to corresponding driving forces of the driving unit 1650 of FIG. 15.

Below, the third stage where the transfer shuttle 200 returns will be described with reference to FIG. 14.

Figure 14:
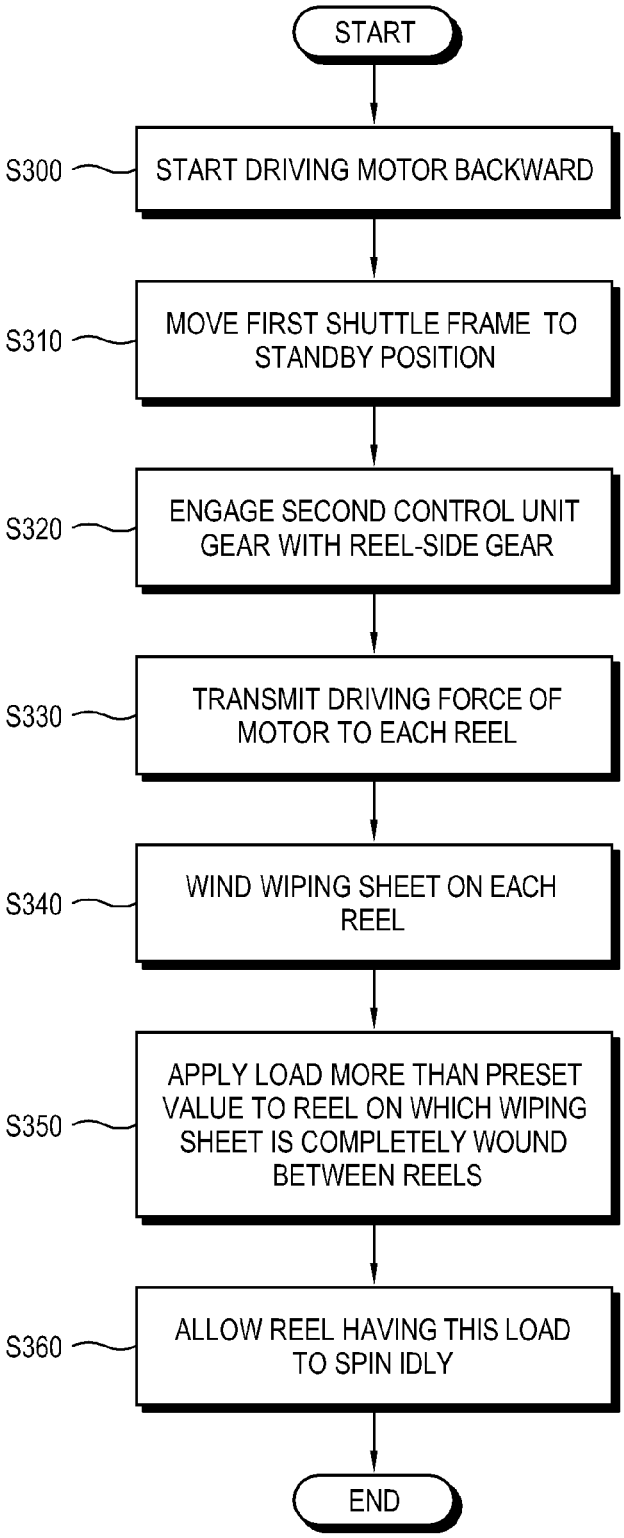

As illustrated in FIG. 14, the motor 310 starts operating backward at operation S300, and the first shuttle frame 210 moves from the return position B to the standby position A at operation S310. At this time, since the second shuttle frame 220 has already moved to the separate position D in the second stage, the wiping is not performed in the third stage.

As the motor 310 operates backward, the second control unit gear 830 matches with the reel-side gear 740 at operation S320, and the driving force of the motor 310 is transmitted to the supplying-side reel 720 and the collecting-side reel 730 at operation S330. Thus, the supplying-side reel 720 and the collecting-side reel 730 wind the wiping sheet 100 released in the first stage, respectively, at operation S340.

While the motor 310 operates backward, if either of the supplying-side reel 720 or the collecting-side reel 730 completes the winding, a load more than a preset value is applied to the winding-completed reel 720 or 730 at operation S350. The reel 720 or 730 receiving the load more than the preset value spins idly and is thus free from the load at operation S360. On the contrary, the other reel 720 or 730, which does not complete the winding and receives a load not more than the preset value, continues to perform the winding.

The operations S300 through S360 may be simultaneously performed according to a control of the controller 1610 of FIG. 15. However, the present general inventive concept is not limited thereto. The operations S300 through S360 can be sequentially performed. It is also possible that the operations S300 through S360 may be selectively performed according to corresponding driving forces of the driving unit 1650 of FIG. 15

Below, the fourth stage where the transfer shuttle 200 reaches the standby position A will be described with reference to FIG. 15.

As illustrated in FIG. 15, the first shuttle frame 210 reaches the standby position A at operation S400.

Thus, the position determining member pressing unit 540 presses the position determining member 510 at operation S410, and the position determining member 510 moves to the forward position E at operation S420. The position determining member 510 is locked by the locking member 520 and stays at the forward position E, and the shuttle frame 220 moves up to the press position C at operation S430.

As the second shuttle frame 220 moves up, the rack gear 610 causes the pinion gear 620 to rotate at operation S440, and correspondingly the first support gear 410 rotates so that the wiping sheet 100 moves as much as a preset section at operation S450. Thus, a new region of the wiping sheet 100 unused in the wiping can be used in the next wiping process.

Meanwhile, as the first shuttle frame 210 reaches the standby position A, the first shuttle frame 210 presses the link pressing member 850 at operation S460. Then, the second control unit link 840 moves up at operation S470, and the second control unit gear 830 is separated from the reel-side gear 740 at operation S480. Thus, the tension is prevented from acting in the opposite direction to the moving direction of the wiping sheet 100 in the operation S450, thereby preventing the whipping sheet 100 from damage and concentrating the driving force of the motor 310 with respect to the moving-up of the second shuttle frame 220 in the operation S430.

When the foregoing stages are completed, the initial state comes back, so that the motor 310 stops operations at operation S490. These stages are repeated for every wiping process, so that the nozzle 31 can be wiped by the simple structure.

The operations S400 through S480 may be simultaneously performed according to a control of the controller 1610 of FIG. 15. However, the present general inventive concept is not limited thereto. The operations S400 through S480 can be sequentially performed. It is also possible that the operations S400 through S480 may be selectively performed according to corresponding driving forces of the driving unit 1650 of FIG. 15.

Referring to FIG. 17A, a screw 200*a* can be rotatably installed on the main frame 10, and the transfer shuttle 200 can move along the screw 200*a* between the standby position A and the return position B. Accordingly, the transfer shuttle 200 may further include a structure to receive a driving force from the driving unit 1650 of the image forming apparatus 1600 of FIG. 16 and then rotate the screw 200*a*. The structure may include a rod 200*a*-1 to support the transfer shuttle 200 with respect to the screw 200*a* when the screw 200*a* rotates to feed the transfer shuttle 200 between the standby position A and the return position B. It is possible that the screw 200*a* can rotate according to a rotation force (driving force) of the motor of the driving unit 300.

Referring to FIG. 17B, a belt 200*b* can be rotatably installed around rollers 200D rotatably installed on a shaft 200*c* disposed on the main frame 10, and the transfer shuttle 200 can move along the belt 200*b* between the standby position A and the return position B. Accordingly, the transfer shuttle 200 may further include a structure to receive a driving force from the driving unit 1650 of the image forming apparatus 1600 of FIG. 16 and then rotate the belt 200*b*. The structure may include a rod 200*b*-1 to support the transfer shuttle 200 with respect to the belt 200*b* when the belt 200*b* rotates to feed the transfer shuttle 200 between the standby position A and the return position B. It is possible that the belt 200*b* can rotate according to a rotation force (driving force) of the motor of the driving unit 300

Referring to FIG. 18A, the wiping sheet storage unit 700 may include first and second wiping sheet storage units 700 formed as two separate bodies and connected to each other through the wiping sheet 100 and/or the transfer shuttle 200. The first and second wiping sheet storage units 700 each may have an opening 700*e* formed on a housing of each of the first and second wiping sheet storage units 700 through which the wiping sheet 100 is extracted and guide by the support rollers 700*d* toward the transfer shuttle 200 and inserted into the opening 250 of the transfer shuttle 200. In this case, two openings 700*e* of the first and second wiping sheet storage units 700 may be disposed to face to each other. The reels 701 may be disposed to wind the wiping sheet 100 in a direction on the Y-Z plane.

Referring to FIG. 18B, the wiping sheet storage unit 700 may include first and second wiping sheet storage units 700 formed as two separate bodies and connected to each other through the wiping sheet 100 and/or the transfer shuttle 200. The first and second wiping sheet storage units 700 each may have an opening 700*e* formed on a housing of each of the first and second wiping sheet storage units 700 through which the wiping sheet 100 is extracted and guide by the support rollers 700*d* and inserted into the opening 250 of the transfer shuttle 200. In this case, two openings 700*e* of the first and second wiping sheet storage units 700 may be disposed to face to each other. However, the reels 701 may be disposed to wind the wiping sheet 100 in a direction on the X-Z plane.

Figure 18C:
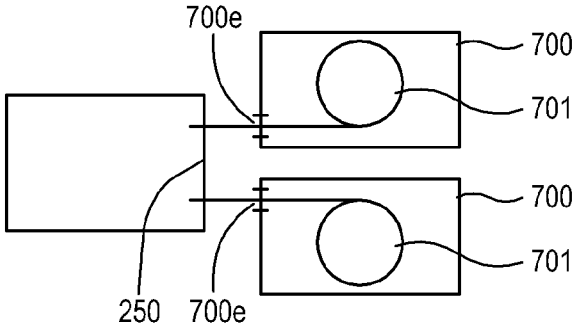

Referring to FIG. 18C, the reels 701 of the first and second wiping sheet storage units 700 are disposed to wind the wiping sheet 100 in a direction on the X-Y plane. The openings 700*e* of the first and second wiping sheet storage units 700 may be disposed to face the transfer shuttle 200 so that the wiping sheet 100 is pulled out from the first and second wiping sheet storage units 700 through the respective openings 700*e* and then inserted into the transfer shuttle 200 through the opening 250 as illustrated in FIG. 18C.

The wiping sheet 100 is pulled (or extracted) out and then extended from the wiping sheet storage unit 700 when the transfer shuttle 200 moves from the standby position A to the return position B with respect to the wiping sheet storage unit 700. It is possible that the wiping sheet 100 has a strength to maintain a connecting state without being loosened when the wiping sheet 100 is extended between the standby position A and the return position B according to a movement of the transfer shuttle 200 to the return position B.

The wiping sheet storage unit 700 and the transfer shuttle 200 may be formed in a single body to move between the standby position A and the return position B. In this case, the wiping sheet storage unit 700 may have a size or volume not to interfere with a movement of the transfer shuttle 200 below the nozzle unit of the image forming cartridge to perform the wiping process. Also in this case, the wiping sheet 200 does not have to be extended or extracted from the standby position A to the return position B.

The controller 1610 of the image forming apparatus 1600 may controls the driving unit 1650 or the driving 300 to selectively supply one or more driving forces to one or more reels 701 as a supplying reel and a take up reel to supply the wiping sheet 200 and take up the wiping sheet 200, respectively, such that the portion of the wiping sheet 200 which has been used for the wiping can be shifted or moved with respect to the pressing member 230 and then a new portion of the wiping sheet 200 can be disposed on the pressing member 230 to face the nozzle 31 of the nozzle unit of the image forming cartridge 30. In this case, the pinion 620 and/or the rack 610 of the wiping sheet moving unit 600 may not be installed in the second shuttle frame 220. However, the present general inventive concept is not limited thereto. The above-described controller 1610 and the wiping sheet moving unit 600 may be used together to move the wiping sheet 100 with respect to the pressing member 230.

Figure 19A:
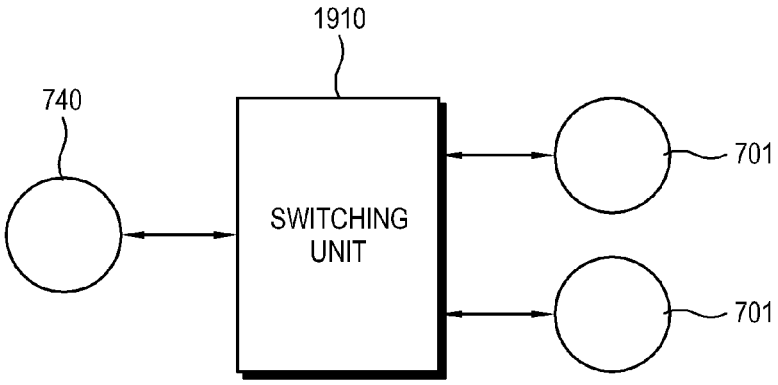
FIGS. 19A and 19B are views illustrating a switching unit to transmit driving force to a wiping sheet storage unit and a transfer shuttle according to an embodiment of the present general inventive concept.

Referring to FIG. 19A, the image forming apparatus 1 may include a switching unit 1910 disposed and coupled between the reel side gear 740 of FIGS. 10 and 11 and reel gears of the reel 701 of FIG. 2. The switching unit 1910 can receive the driving force (or rotating force) generated from the driving unit 300 of FIG. 10 and then transmit the driving force to the reels (reel gears) 701 through the reel side gear 740. It is possible that the switching unit 1910 can selectively transmit the driving force to either one of the reels (reel gears) 701 through the reel side gear 740. In this case, one of the reels 701 does not rotate and the other one of the reels 701 rotates. Accordingly, it is possible that the one reel 701 does not wind or release the wiping sheet 100 and that the other reel winds or release the wiping sheet 100. When the transfer shuttle 200 moves away from the wiping sheet storage unit 700, and the wiping sheet 100 is extended from the wiping sheet storage unit 700, at least one reel dose not rotate to hold the wiping sheet 100 while the other reel can rotate to release the wiping sheet 100. It is also possible that when the transfer shuttle 200 moves toward the wiping sheet storage unit 700 from the return position B to the standby position A, and the wiping sheet 100 returns to the wiping sheet storage unit 700, at least one reel dose not rotate to hold the wiping sheet 100 while the other reel can rotate to wind the wiping sheet 100 around the reel.

Figure 19B:
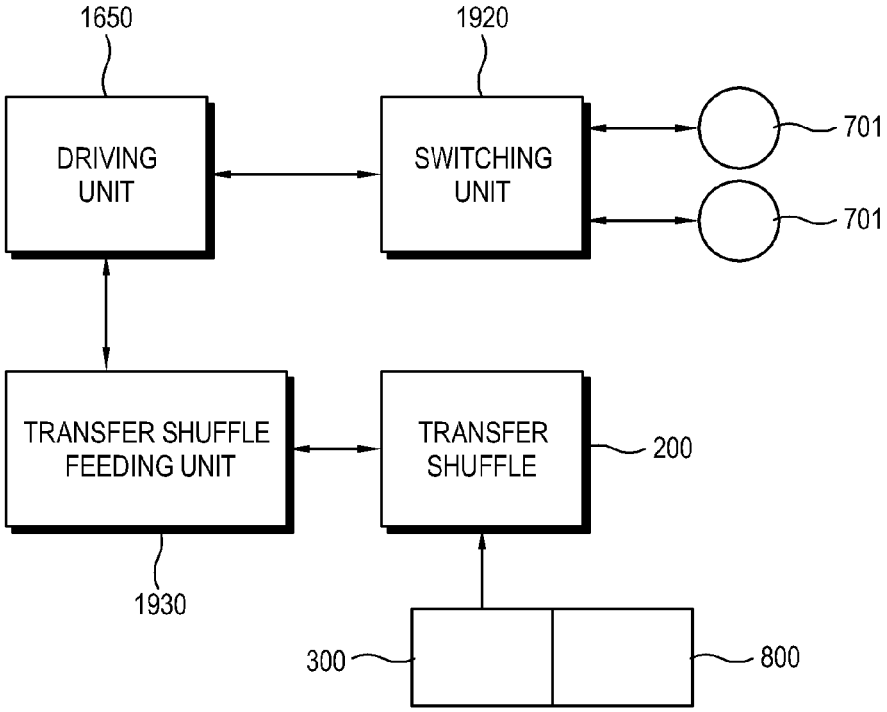

Referring to FIG. 19B, the image forming apparatus 1 may include a switching unit 1920 and a transfer shuttle feeding unit 1930. The switching unit 1920 may be same as or similar to the switching unit 1910 of FIG. 19A. However, the switching unit 1920 may not receive the driving force from the reel side gear 740 but from the driving unit 1650 of FIG. 16. The transfer shuttle feeding unit 1930 may receive a driving force from the driving unit 1650 and then transmit the driving force to the transfer shuttle 200, e.g., the structure to move the transfer shuttle 200 with respect to the screw 200*a* of FIG. 17A or the belt 200*b* of FIG. 17B.

As described above, the transfer shuttle 200 is movable with respect to the image forming cartridge 30 or the wiping sheet storage unit 700, and the wiping sheet 100 is extended (extracted) from the wiping sheet storage unit 700 by a length corresponding to a distance between the standby position A and the return position B. The image forming cartridge 30 is stationary with respect to the transfer shuttle 200 or the main frame 10. The driving unit 300 and the power transmission control unit 800 of FIG. 10 may move together with the transfer shuttle 200. However, the present general inventive concept is not limited thereto. At least one of the driving unit 300 and the power transmission control unit 800 of FIG. 10 may not move together with the transfer shuttle 200, and an additional transmission unit may be disposed between the transfer shuttle 200 and the at least one of the driving unit 300 and the power transmission control unit 800 to transmit the driving force to the transfer shuttle 200 to perform the above-described operations of FIGS. 12-15.

The wiping sheet 100 may be formed with fabric or other material to clean the nozzles 31 or wipe an area of the nozzles 31 to remove a remaining ink or foreign material from the nozzles 31 or the nozzle unit.

Although FIG. 2 illustrates an opening 711 formed on a middle position between the reels 701, it is possible that the opening 711 can be formed at a position which is closer to one reel 701 than the other reel 701. In this case, the support guides 700*d* may be disposed to guide the wiping sheet 100 to be pulled from or taken up to corresponding reels 701.

The present general inventive concept can also be embodied as computer-readable codes on a computer-readable medium. The computer-readable medium can include a computer-readable recording medium and a computer-readable transmission medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As apparent from the foregoing description, the wiping sheet is supported not to move while performing the wiping process, so that the amount of the wiping sheet used in the wiping process can be reduced, thereby prolonging the replacement cycle of the wiping sheet.

Also, after terminating the wiping process, the wiping sheet to be used in the wiping process is shifted in position for the next wiping process, so that every wiping process can have a uniform wiping effect, thereby guaranteeing the quality of an image on the print medium.

Further, the wiping is performed by bring the nozzle into contact with a surface of a belt-type wiping sheet, thereby protecting the nozzle as compared with that in a blade-type wiping configuration.

Moreover, the second shuttle frame or the wiping sheet is moved not under control of an additional motor or controller but by mechanical operation of relevant components, thereby simplifying and minimizing the configuration.

Furthermore, the configuration where the wiping sheet is wound and stored is arranged substantially perpendicularly to a wiping direction, thereby minimizing the apparatus.

Also, operations of a supplying-side reel and a collecting-side reel are mechanically controlled to correspond to when the wiping is performed by the transfer shuttle and when the transfer shuttle is returned after the wiping is terminated, respectively, so that the wiping can be performed while the wiping sheet is fixed.

Further, the supplying-side reel and the collecting-side reel are configured to idly spin when a load more than a preset value is applied thereto, so that the wiping sheet can be properly wound without damage even though a rotation radius of the wiping sheet is steadily changed as the wiping process is repeated.

Furthermore, the power transmission for the supplying-side reel and the collecting-side reel is controlled when the transfer shuttle returns to the standby position and the second shuttle frame moves to a press position, so that the driving force of the motor can be concentrated on moving the second shuttle frame, and tension cannot be caused in the direction opposite to the moving direction of the wiping sheet, thereby preventing the wiping sheet from damage.

Although a few exemplary embodiments of the present general inventive concept have been shown and described, it will be appreciated by those skilled in the art that changes may be made in these embodiments without departing from the principles and spirit of the invention, the scope of which is defined in the appended claims and their equivalents.

What is claimed is:

1. An inkjet image forming apparatus comprising:

a main body frame;

a medium supplying unit that is coupled to the main body frame and that supplies a print medium;

an image forming cartridge that is coupled to the main body frame, and that forms an image on the supplied print medium, and comprises a nozzle to eject ink; and a wiping assembly which wipes the nozzle, wherein the wiping assembly comprises:

a wiping sheet storage unit in which the wiping sheet is stored as being wound;

a transfer shuttle that is separated from the wiping sheet storage unit to move away from and towards the wiping sheet storage unit during the wiping of the nozzle such that the transfer shuttle moves along an arrangement of the nozzle by a driving force of a driving source;

a pressing member which is provided in the transfer shuttle and presses a region of the wiping sheet against the nozzle to perform wiping using the wiping sheet; and a wiping sheet support unit that is provided in the transfer shuttle and that restricts movement of the wiping sheet with respect to the nozzle while the nozzle is wiped.

2. The inkjet image forming apparatus of claim 1, wherein the wiping sheet support unit applies tension to the wiping sheet in a direction opposite to friction acting between the nozzle and the wiping sheet when performing the wiping.

3. The inkjet image forming apparatus of claim 2, wherein the wiping sheet support unit comprises a plurality of support gears matching with each other with the wiping sheet therebetween to support the wiping sheet.

4. The inkjet image forming apparatus of claim 1, wherein the transfer shuttle comprises:

a first shuttle frame which moves between a standby position corresponding to one side end of the nozzle and a return position corresponding to the other side end of the nozzle; and a second shuttle frame in which the pressing member is provided, and which is coupled to the first shuttle frame so that the pressing member is movable between a press position to press the wiping sheet against the nozzle and a separate position separated from the press position.

5. The inkjet image forming apparatus of claim 4, wherein the wiping assembly further comprises a frame position shifting unit makes the second shuttle frame stay at the press position when the first shuttle frame moves from the standby position to the return position, but makes the second shuttle frame at the separate position when the first shuttle frame moves from the return position to the standby position.

6. The inkjet image forming apparatus of claim 4, wherein the wiping assembly further comprises a wiping sheet moving unit which makes the region of the wiping sheet pressed by the pressing member move as much as a predetermined section.

7. The inkjet image forming apparatus of claim 1, wherein the wiping sheet storage unit stores one side of the wiping sheet not used in the wiping to be supplied to the transfer shuttle, but collects and stores the other side of the wiping sheet used in the wiping from the transfer shuttle.

8. The inkjet image forming apparatus of claim 7, wherein the wiping sheet storage unit comprises:

a storage unit housing in which the wiping sheet is stored;

a supplying-side reel which is provided in the storage unit housing and around which one side of the wiping sheet not used in the wiping is wound; and a collecting-side reel which is provided in the storage unit housing and around which the other side of the wiping sheet used in the wiping is wound.

9. The inkjet image forming apparatus of claim 8, wherein the transfer shuttle moves between the standby position corresponding to the one side end of the nozzle and the return position corresponding to the other side end of the nozzle, and the supplying-side reel and the collecting-side reel are provided to release the wound wiping sheet when the transfer shuttle moves from the standby position to the return position, but receive the driving force from the driving source to wind the released wiping sheet when the transfer shuttle moves from the return position to the standby position.

10. The inkjet image forming apparatus of claim 9, wherein the supplying-side reel and the collecting-side reel spin idly without winding the wiping sheet if receiving a load more than a preset value while winding the wiping sheet as the transfer shuttle moves to the standby position.

11. The inkjet image forming apparatus of claim 8, wherein:

the transfer shuttle moves between the standby position corresponding to the one side end of the nozzle and the return position corresponding to the other side end of the nozzle; and the wiping assembly comprises a power transmission control unit that cuts off the driving force for winding the wiping sheet from being transmitted to the supplying-side reel and the collecting-side reel when the transfer shuttle moves from the standby position to the return position, but allows the driving force to be transmitted to the supplying-side reel and the collecting-side reel when the transfer shuttle moves from the return position to the standby position.

12. The inkjet image forming apparatus of claim 1, wherein the wiping sheet storage unit is placed in one of opposite ends of a moving course for the transfer shuttle.

13. The inkjet image forming apparatus of claim 1, wherein the wiping sheet storage unit is provided substantially perpendicularly to the moving direction of the transfer shuttle.

14. A wiping assembly usable with an inkjet image forming apparatus having a nozzle to inject ink, comprising:

a wiping sheet storage unit in which a wiping sheet is stored as being wound;

a transfer shuttle that is separated from the wiping sheet storage unit to move away from and towards the wiping sheet storage unit during the wiping of the nozzle such that the transfer shuttle moves along an arrangement of the nozzle by a driving force of a driving source;

a pressing member which is provided in the transfer shuttle and presses a region of the wiping sheet against the nozzle to perform wiping using the wiping sheet; and a wiping sheet support unit that is provided in the transfer shuttle and that restricts movement of the wiping sheet with respect to the nozzle while the nozzle is wiped.

* * * * *